US010758038B2

(12) United States Patent
Ruzicka et al.

(10) Patent No.: US 10,758,038 B2
(45) Date of Patent: Sep. 1, 2020

(54) ARTICLE OF FURNITURE AND METHOD OF USING THE SAME

(71) Applicant: Knoll, Inc., East Greenville, PA (US)

(72) Inventors: Pavel Ruzicka, Pennsburg, PA (US); Mark P. Scafini, East Greenville, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 16/417,720

(22) Filed: May 21, 2019

(65) Prior Publication Data

US 2019/0365091 A1 Dec. 5, 2019

Related U.S. Application Data

(60) Provisional application No. 62/677,353, filed on May 29, 2018.

(51) Int. Cl.
*A47B 13/08* (2006.01)

(52) U.S. Cl.
CPC .... *A47B 13/081* (2013.01); *A47B 2200/0043* (2013.01); *A47B 2200/12* (2013.01)

(58) Field of Classification Search
CPC ..... A47B 13/081; A47B 2200/0043; A47B 2200/12; A47B 3/00; A47B 3/08
USPC ..... 108/115, 60
See application file for complete search history.

(56) References Cited

U.S. PATENT DOCUMENTS 2,240,729 A * 5/1941 Von Palmenberg .... A47F 3/005 16/390
2,942,924 A * 6/1960 Stangert ..... A47B 21/03 312/140.4
4,055,124 A * 10/1977 Weagle ..... A47B 3/0815 108/132
4,670,938 A * 6/1987 Fowlston ..... B65D 43/168 16/225
4,809,619 A 3/1989 Piretti
4,827,850 A * 5/1989 Diffrient ..... A47B 1/04 108/50.02
4,828,132 A * 5/1989 Francis, Jr. ..... B65D 11/1853 16/225
5,353,715 A * 10/1994 Luyk ..... A47B 9/16 108/116
5,539,955 A * 7/1996 Wiese ..... E05D 1/02 16/225
5,729,867 A * 3/1998 Carmichael ..... E04B 2/7429 16/225
5,890,782 A * 4/1999 Alberts ..... A47B 17/00 312/196
5,927,214 A * 7/1999 Schwartz ..... A47B 3/0815 108/115
6,062,147 A * 5/2000 Footitt ..... A47B 17/00 108/50.01
D427,783 S 7/2000 Luedke
6,164,217 A 12/2000 Prendergast
(Continued)

*Primary Examiner* — Jose V Chen
(74) *Attorney, Agent, or Firm* — Buchanan Ingersoll & Rooney PC

(57) ABSTRACT

An article of furniture can include a flipping actuation mechanism. A privacy screen apparatus can also be connectable to the article of furniture. The flipping actuation mechanism and the privacy screen apparatus can each be configured to facilitate flipping and stacking or nesting of tables or other types of articles of furniture.

14 Claims, 15 Drawing Sheets

(56) References Cited

U.S. PATENT DOCUMENTS 6,427,608 B1 * 8/2002 Crinion ..... A47B 21/06 108/50.02
6,637,352 B1 10/2003 Thode et al.
6,662,731 B2 12/2003 Teppo et al.
6,732,660 B2 * 5/2004 Dame ..... A47B 13/003 108/50.01
6,845,723 B2 1/2005 Kottman et al.
7,066,098 B2 6/2006 Blasen et al.
7,343,864 B2 * 3/2008 Canin ..... A47B 47/00 108/50.02
7,614,351 B2 11/2009 Piretti
7,712,422 B2 5/2010 Bue
7,789,025 B2 * 9/2010 Michaud, II ..... A47B 17/02 108/147
7,827,920 B2 * 11/2010 Beck ..... A47B 83/001 108/50.02
7,845,290 B2 12/2010 Piretti
7,878,128 B2 2/2011 Watson et al.
8,051,784 B2 11/2011 Hsu
8,069,795 B1 12/2011 Williams et al.
8,091,488 B2 1/2012 Chirea et al.
8,171,863 B2 5/2012 Nyenhuis et al.
8,196,526 B2 * 6/2012 Rheault ..... A47B 13/10 108/50.01
8,297,208 B2 10/2012 Hoffman
8,359,983 B2 1/2013 Williamson et al.
8,413,593 B2 4/2013 Korb
8,578,864 B2 11/2013 Nyenhuis et al.
D696,883 S 1/2014 Krusin
8,667,909 B2 3/2014 Ruzicka
8,869,715 B2 10/2014 Hoffman
9,265,340 B2 2/2016 Krusin et al.
9,609,945 B2 4/2017 Krusin et al.
9,629,451 B2 4/2017 Harper
9,642,451 B2 * 5/2017 Okuda ..... A47B 3/08
9,681,763 B2 6/2017 Udagawa et al.
9,730,513 B2 8/2017 Udagawa et al.
D799,861 S 10/2017 Krusin
9,920,520 B2 3/2018 Udagawa et al.
10,299,581 B2 * 5/2019 Keller ..... A47B 9/08
10,413,063 B2 * 9/2019 Lee ..... A47B 87/002
2008/0196635 A1 8/2008 Piretti
2008/0210144 A1 * 9/2008 Prendergast ..... A47B 3/002 108/116
2014/0158024 A1 6/2014 Henriott
2014/0261094 A1 * 9/2014 Parshad ..... A47B 17/00 108/28
2019/0142155 A1 * 5/2019 Lee ..... A47B 87/002 108/27

* cited by examiner

ARTICLE OF FURNITURE AND METHOD OF USING THE SAME

CROSS-REFERENCE TO RELATED APPLICATIONS

The present application claims priority to U.S. Provisional Patent Application No. 62/677,353, which was filed on May 29, 2018. The entirety of this provisional patent application is incorporated by reference herein.

FIELD OF INVENTION

The innovation relates to articles of furniture, such as tables, desks, or other types of furniture and methods of using articles of furniture.

BACKGROUND OF THE INVENTION

Tables and other articles of furniture are often configured to have a number of legs that support a surface. For instance, tables may have legs, a stand or other type of base that supports a tabletop and a chair may have a pedestal, legs, or other type of base that supports a seat and/or a backrest. Examples of articles of furniture may be appreciated from U.S. Pat. Nos. 4,809,619, 6,164,217, 6,637,352, 6,662,731, 6,845,723, 7,066,098, 7,614,351, 7,712,422, 7,845,290, 7,878,128, 8,051,784, 8,069,795, 8,091,488, 8,171,863, 8,297,208, 8,359,983, 8,413,593, 8,578,864, 8,667,909, and 8,869,715 and U.S. Pat. App. Pub. No. 2008/0196635. U.S. Pat. Nos. 9,629,451, 9,609,945, and 9,265,340 and U.S. Design Pat. Nos. D696,883 and D799,861 also disclose examples of an article of furniture and mechanisms that may be used in articles of furniture.

Some types of tables, chairs and other kinds of furniture may be nested, or stacked when stored to preserve space. For instance, tables or chairs may be configured to be stacked on top of each other or nested beside other tables. But, keeping an article of furniture in a configuration for nesting and/or stacking can often be problematic. For instance, some articles of furniture may be designed so that they are easily adjusted from a stacked or nested position to a use position. But, such ease of adjustability may also result in the article of furniture adjusting positions when a user does not desire this change in position to occur. Further, such an ease of adjustability can also contribute to users becoming injured or hurt when the position of the article is adjusted.

Some types of furniture can permit people to easily see who may or may not be working at or near the furniture. The lack of privacy can also be a distraction to a worker or team of personnel that are working. A privacy screen can help address such issues. Examples of a privacy screen for a table can be appreciated from U.S. Pat. App. Pub. No. 2014/0158024 and U.S. Pat. No. 9,920,520. Other examples of privacy screens can be appreciated from U.S. Design Pat. No. D427,783 and U.S. Pat. Nos. 9,730,513 and 9,681,763. Tilting, or flipping, of tables can complicate installation and removal of privacy screens. For instance, flipping of tables for storage or nesting can require a privacy screen to be removed from a tabletop prior to the flipping to occur to avoid damaging the privacy screen.

SUMMARY OF THE INVENTION

An article of furniture, a flipping mechanism for an article of furniture, and a method of using such an article of furniture and/or such a flipping mechanism are provided. In some embodiments, an article of furniture may include a flipping mechanism that is actuatable to unlock a position of a tabletop or desktop so that the structure is moveable from a use position to a flipped position in which the article is more effectively stackable or nestable with other article of furniture (e.g. stacked set of tables or nested set of tables, etc.). In some embodiments of the method, use of an embodiment of such a flipping mechanism can include using a flipping actuation mechanism to unlock the position of the work surface prior to the article of furniture being moved from a use position to a flipped position and/or vice versa.

A privacy screen apparatus is also provided that can be connectable to a tabletop or desktop. The privacy screen can be configured to stay attached to a tabletop even when the tabletop is in a flipped position and can also be configured to help facilitate storage or nesting of such a table. Some embodiments of an article of furniture can include a privacy screen apparatus as well as a flipping mechanism.

An embodiment of an article of furniture can include a base that supports a work surface and a first flip connector attaching the work surface to the base such that the work surface is moveable between a first position and a second position. The first flip connector can include a housing having a first upper element attachable to the work surface and a second lower element attachable to the base. The first upper element can be moveable relative to the second lower element. The first flip connector can also include an actuation member, a guide passing through the actuation member, an elongated member passing through the actuation member, and a biasing member positioned adjacent the guide that engages the actuation member to bias the actuation member to an initial position.

In some embodiments, the first flip connector can include a first locking structure attached to the actuation member. The first locking structure can define a first locking ramp that extends linearly from a top of the first locking ramp to a bottom of the first locking ramp at a first pre-selected angle. The first locking structure can also include an upper surface that extends from the top of the first locking ramp and is adjacent a wall of the actuation member that extends vertically above the upper surface of the first locking structure.

The first flip connector can also include other elements in some embodiments. For example, the first flip connector can also include a second locking structure having a second locking ramp that is configured to cooperate with the first locking ramp such that the first locking ramp is contactable with the second locking ramp and slideable along the second locking ramp such that sliding of the first locking ramp along the second locking ramp drives motion of the actuation mechanism attached to the first locking structure so that the actuation mechanism moves between the initial position and an unlocking position as the first locking ramp slides along the second locking ramp. The first locking ramp can slide from a top of the second locking ramp to a bottom of the second locking ramp to drive motion of the actuation mechanism from the initial position to the unlocking position. The second locking structure can have a projecting portion that extends from a body of the second locking structure to the bottom of the second locking ramp. The upper surface of the first locking structure can be slideable along the projecting portion as the actuation member is moved from the unlocking position to the initial position after the first locking structure has moved below the bottom of the second locking ramp.

Embodiments of the article of furniture can also include other flip connectors. For example, there can be a second flip connector attaching the work surface to the base such that the work surface is moveable between the first position and the second position. The second flip connector can be positioned adjacent a second side of the work surface and the first flip connector can be positioned adjacent a first side of the work surface that is opposite the second side. The second flip connector can have a similar structure to the first flip connector. For instance, the second flip connector can include a housing having a first upper element attachable to the work surface and a second lower element attachable to the base. The first upper element can be moveable relative to the second lower element. The second flip connector can also include: an actuation member, a guide passing through the actuation member such that the actuation member is moveable along the guide between an initial position and an unlocking position, the elongated member passing through the actuation member; a biasing member positioned adjacent the guide that engages the actuation member to bias the actuation member to the initial position; and a first locking structure attached to the actuation member. The first locking structure of the second flip connector can define a first locking ramp that extends linearly from a top of the first locking ramp to a bottom of the first locking ramp at a first pre-selected angle. The first locking structure of the second flip connector can also have an upper surface that extends from the top of the first locking ramp and is adjacent a wall of the actuation member that extends vertically above the upper surface of the first locking structure. The second flip connector can also include a second locking structure having a second locking ramp that is configured to cooperate with the first locking ramp such that the first locking ramp is contactable with the second locking ramp and slideable along the second locking ramp such that sliding of the first locking ramp along the second locking ramp drives motion of the actuation mechanism attached to the first locking structure so that the actuation mechanism moves between the initial position and the unlocking position as the first locking ramp slides along the second locking ramp. The first locking ramp of the second flip connector can slide from a top of the second locking ramp to a bottom of the second locking ramp to drive motion of the actuation mechanism of the second flip connector from the initial position to the unlocking position. The second locking structure of the second flip connector can have a projecting portion that extends from a body of the second locking structure to the bottom of the second locking ramp. The upper surface of the first locking structure of the second flip connector can be slideable along the projecting portion as the actuation member of the second flip connector is moved from the unlocking position to the initial position after the first locking structure has moved below the bottom of the second locking ramp.

Embodiments of the article of furniture can also include a privacy screen apparatus. For instance, there can be a lower privacy screen body that is positioned below a front edge of the work surface. The lower privacy screen body can be attached to the work surface via a plurality of resilient lower privacy screen connectors. There may also be an upper privacy screen body that is attached to the lower privacy screen body via the resilient lower privacy screen connectors. The upper privacy screen body can be attached to the work surface so that the upper privacy screen body extends above the work surface.

Embodiments of the article of furniture can be configured so that the guide has a lower ramped surface configured to facilitate automatic motion of the actuation member for its initial position to an unlocking position to facilitate easy adjustment of the work surface to its initial work position from a flipped or tilted position. This feature, in conjunction with the biasing member, can also permit the work surface to be locked in its work position after being so moved to that position without requiring the use to have to provide any manipulation of an actuator. In some such configurations, the guide can have a first end and a second end opposite the first end of the guide. The first end of the guide can define a lower ramped surface. The guide can be connected to the actuation member so that motion of the guide also results in motion of the actuation member. The first end of the guide can be spaced apart from the actuation member when the actuation member is in its initial position. The second end of the guide can be spaced apart from the actuation member such that the actuation member is spaced apart from the opposite first and second ends of the guide and is intermediate those ends when the actuation member is in the initial position. The lower element of the housing can have a component that has an opening through which the first end of the guide is passable. The lower ramped surface of the first end of the guide can be configured to contact a top of the component of the lower element to move the guide away from the component so that the actuation member is moved from the initial position toward an unlocking position when the work surface is moved from its second position (which can be a flipped or tilted position) to its first position (which can be a work position, or a position in which the work surface extends horizontally or generally horizontally between its front and rear edges and also extends horizontally or generally horizontally between its left and right side edges).

Embodiments of the article of furniture can also include a second flip connector also having such a guide configuration. For instance, there can be a second flip connector that includes a housing having a first upper element attachable to the work surface and a second lower element attachable to the base. The first upper element of the housing of the second flip connector can be moveable relative to the second lower element of the second flip connector. The second flip connector can also include: an actuation member; a guide passing through the actuation member with the elongated member passing through the actuation member, and a biasing member positioned adjacent the guide that engages the actuation member to bias the actuation member to the initial position. The lower element of the housing of the second flip connector can have a component. The component of the lower element of the housing of the second flip connector can have an opening through which the first end of the guide of the second flip connector is passable. The lower ramped surface of the guide of the second flip connector can be configured to contact a top of the component of the lower element of the second flip connector to move the guide of the second flip connector away from the component so that the actuation member of the second flip connector is moved from the initial position toward an unlocking position. The second flip connector can be configured so that the lower ramped surface of the guide of the second flip connector moves at the same time the guide of the first flip connector moves for moving the actuation members of the first and second flip connectors simultaneously from their initial position to the unlocking position and vice versa.

An article of furniture is also provided that includes a privacy screen apparatus. For example, an article of furniture can include a base that supports a work surface and a privacy screen apparatus. The privacy screen apparatus can include a lower privacy screen body that is positioned below a front edge of the work surface. The lower privacy screen body can be attached to the work surface via a plurality of resilient lower privacy screen connectors.

The privacy screen apparatus can also include n upper privacy screen body that is attached to the lower privacy screen body via the resilient lower privacy screen connectors. The upper privacy screen body can be attached to the work surface so that the upper privacy screen body extends above the work surface when the work surface is in a first position.

The resilient lower privacy screen connectors can be configured so that the lower privacy screen body is moveable relative to the work surface when the work surface is flipped via a flip mechanism connected between the base and the work surface so that the lower privacy screen body is positioned below the front edge of the work surface when the work surface is tilted from the first position to a second position The front edge of the work surface can be a bottom edge of the work surface when the work surface is in the second position.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of an article of furniture having a flipping actuation mechanism, a flipping actuation mechanism, and a privacy screen apparatus for an article of furniture are shown in the accompanying drawings and certain exemplary methods of practicing the same are also illustrated therein. It should be appreciated that like reference numbers used in the drawings may identify like components.

DETAILED DESCRIPTION OF EXEMPLARY EMBODIMENTS

Referring to FIGS. 1-19, an article of furniture 1 can include a work surface 3 (e.g. a tabletop or desktop). The work surface 3 can have a front end 3*f*, a rear edge 3*r*, a first side edge 3*a* that is between the front and rear edges 3*f* and 3*r* and a second side edge 3*b* that is opposite the first side edge and extends between the front and rear edges 3*f* and 3*r*. The first and second side edges may be right and left side edges or vice versa.

In some embodiments, the work surface 3 may have a circular or oval shape so that it has a single continuous edge. In other embodiments, the shape of the work surface can be polygonal, hexagonal, or have another type of shape. Such work surfaces may still have front and rear sides and left and right sides even though they have a different shape or more or less peripheral edges.

The work surface 3 is supported by a base 9. The base 9 can include a plurality of legs 9*b* and a plurality of feet 9*c*. The feet 9*c* can include glides or castors that are connected to a bottom end of a leg 9*b*. The base 9 can also include a cross-member 9*a* that can extend from adjacent a first leg 9*b* to adjacent a second leg 9*b*. For instance, the cross-member 9*a* can be positioned below the work surface when the work surface is in a non-flipped position and extend from adjacent a first leg 9*b* positioned adjacent first side of the work surface to a position that is adjacent a second leg 9*b* located adjacent a second side of the work surface 3.

Figure 1:
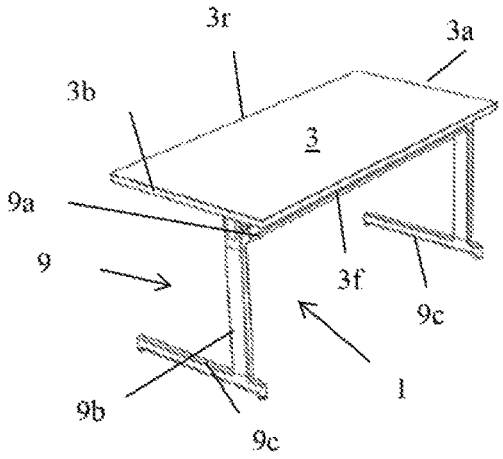
FIG. 1 is a perspective view of a first exemplary embodiment of the article of furniture in a first position.
Figure 2:
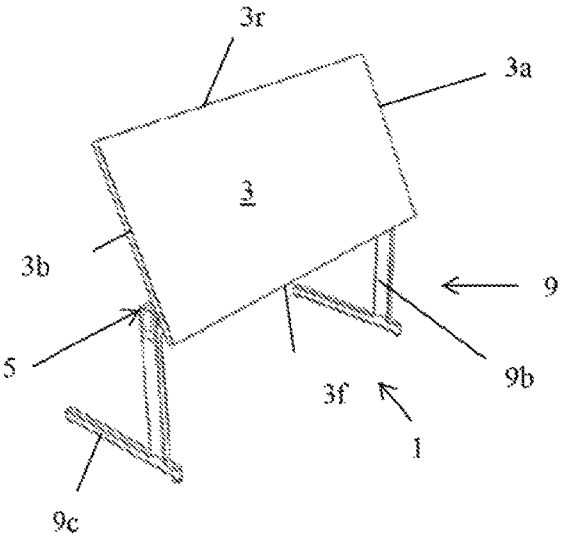
FIG. 2 is a perspective view of the first exemplary embodiment of the article of furniture in a second position.

The article of furniture 1 can also include a flipping mechanism 4 that is connected to the work surface 3 so that the work surface 3 is moveable (e.g. tiltable) from a work position to a tilted position or a flipped position. In the work position (e.g. a first position), the work surface can extend horizontally from its rear edge 3*r* to its front edge 3*f* as shown in FIG. 1. In the flipped position or tilted position (e.g. a second position), the work surface 3 can extend vertically or at an angle relative to horizontal (e.g. an angle of 60°-90° relative to horizontal) as shown in FIG. 2. The inclination of the work surface while in the flipped position can permit the article to be nested with other articles in a more compact manner to ensure a space efficient storage of multiple articles of furniture can be provided.

The flipping mechanism 4 can include at least one flipping actuation mechanism 4*a* that is positioned in a flip connector 5 that is connected between the base 9 and the work surface 3 of the article of furniture 1. The flipping actuation mechanism can include an elongated member 7 (e.g. a rail, a bar, a rod, a tube, etc.) that extends from a first flip connector 5*a* positioned adjacent a first side of the work surface 3 to a second flip connector 5*b* positioned adjacent a second side of the work surface that is opposite the first side. A first end portion 7*a* of the elongated member 7 can extend through the first flip connector 5*a* and a second end portion 7*b* of the elongated member can extend through the second flip connector 5*b*. A middle portion 7*c* of the elongated member 7 can extend between the first and second flip connectors 5*a* and 5*b*.

Each flip connector 5 can define a housing 17 in which a number of elements are positionable. For instance, each flip connector 5 can include a housing 17 that has an upper element 17*a* that is connected to a lower element 17*b*. The upper element 17*a* can be configured for attachment to the bottom of a work surface 3 (e.g. bottom of a tabletop or desktop) via one or more fasteners 31 (e.g. screws, staples, nails, or bolts) or can be attached thereto via welding or an adhesive and/or other attachment mechanism and/or combinations thereof.

The lower element 17*b* can be configured for attachment to a top end portion of a leg 9*b*. One or more fasteners 51 or another type of attachment mechanism can be utilized to attach the lower element 17*b* to a leg 9*b*. The lower element may also include a cross member connector 27 that can extend from a bottom of the lower element or be attached to the bottom of the lower element. The cross member connector can include a hook-like element or flange-like element that includes one or more apertures for facilitating a connection to an end portion of a base cross-member 9*a*. For instance, the cross-member connector 27 can be configured to facilitate an attachment between the cross-member 9*a* and the lower element 17*b* via a fastener and/or a mating profile that can be configured to interlock with a corresponding profile defined inside an end portion of the cross-member 9*a*. In other embodiments, cross-member connectors 27 can extend from upper portions of opposed legs 9*b* or there may be a cross-member connector 27 attached to the upper end of each leg 9*b* for attachment of the cross-member 9*a* to the legs 9*b*.

A rear end 23 of the lower element can define an end wall that is configured to receive a bumper 21 that can cover the end wall. Such a bumper 21 can be composed of a material that is softer than the material of the lower element 17*b* (e.g. the bumper can be composed of a polymeric material, rubber, or elastomeric material and the lower element can be composed of a metal such as steel or aluminum). The bumper 21 can be positioned on the rear end 23 of the lower element 17*b* so that when the work surface is in the flipped position, the bumper can be brought into contact with another work surface in the flipped position to avoid damage to a work surface that may occur from a user nesting or stacking multiple articles of furniture in the flipped position next to each other.

The upper element 17*a* can be connected to the lower element 17*b* so that the upper element 17*a* is moveable relative to the lower element 17*b* via an axle 25 (e.g. a rod, a bar, a tube, a pin, etc.) that extends through sidewalls 17*c* of the upper element 17*a* and axle receiving members 17*d* of the lower element 17*b*. The axle 25 can define an axis about which the upper element 17*a* is rotatable relative to the lower element 17*b* that is attachable to a leg 9*b*. The sidewalls 17*c* can be positioned to extend along and outside of the axle receiving members 17*d* to enclose the axle receiving members 17*d* when the work surface 3 is in the first work position such that the upper and lower elements 17*a* and 17*b* can function as a housing for elements located within the cavity of the housing defined by the upper and lower elements 17*a* and 17*b*. The enclosure can also help avoid exposing a user to pinch points that could exist as a result of actuation of the flipping actuation mechanism 4*a* of the flipping mechanism 4.

Each sidewall 17*c* of the upper element 17 can extend downwardly from a top of the upper element 17*a* that is fastened and/or otherwise attached to a bottom of the work surface 3. Each sidewall 17*c* can extend from a respective side of the top of the upper element (e.g. there may be a left sidewall and a right sidewall, or there may be first and second sidewalls on opposite sides of the upper element, etc.). Each sidewall 17*c* can define an aperture 15 through which a middle portion of the elongated member 7*c* can pass. The aperture of a first sidewall 17*c* can be aligned with the aperture 15 of the second sidewall so that the elongated member 7 is passable through both apertures 15. Each aperture 15 can have an L-like shape or other shape having a vertical segment 15*b* extending vertically along the sidewall and a horizontal segment 15*a* extending horizontally above the vertically extending segment. The lower vertically extending segment 15*b* can have an open mouth that is for receiving the elongated member 7 such that the elongated member is slideable along the sidewall 17*c* via the path defined by the lower vertically extending segment 15*a* and horizontally extending segment 15*b* of the aperture 15. The mouth of the aperture 15 can facilitate positioning of the elongated member 7 through the upper element 17*a* for connection of the upper element 17 to the elongated member 7. The lower element 17*b* can be structured so that the elongated member 7 is free to move along the path of travel defined by the apertures 15 as the elongated member 7 extends through the sidewalls 17*c* via the apertures 15 along the full range of motion along the path defined by the apertures 15.

Each end section of an elongated member 7 that is positionable within the enclosure of the upper and lower elements 17 and 17*b* can be passed through a channel defined in an actuation member 43 so that the actuation member 43 is moveably positionable within a cavity defined by the sidewalls 17*c* and top of the upper element 17*a* and the lower element 17*b* via linear motion of the elongated member 7 (e.g. leftward or rightward motion of the elongated member, etc.), which can result in motion of the actuation member 43 via its attachment to the elongated member 7. In some embodiments, each end portion (e.g. first and second end potions 7*a* and 7*b*) can be coupled to a respective actuation member 43 in such a manner. In other embodiments, only one flip connector may house an actuation member 43 (e.g. only the first end portion 7*a* may be connected to an actuation member 43 or only the second end portion 7*b* may be connected to an actuation member 43 in some embodiments).

Figure 20:
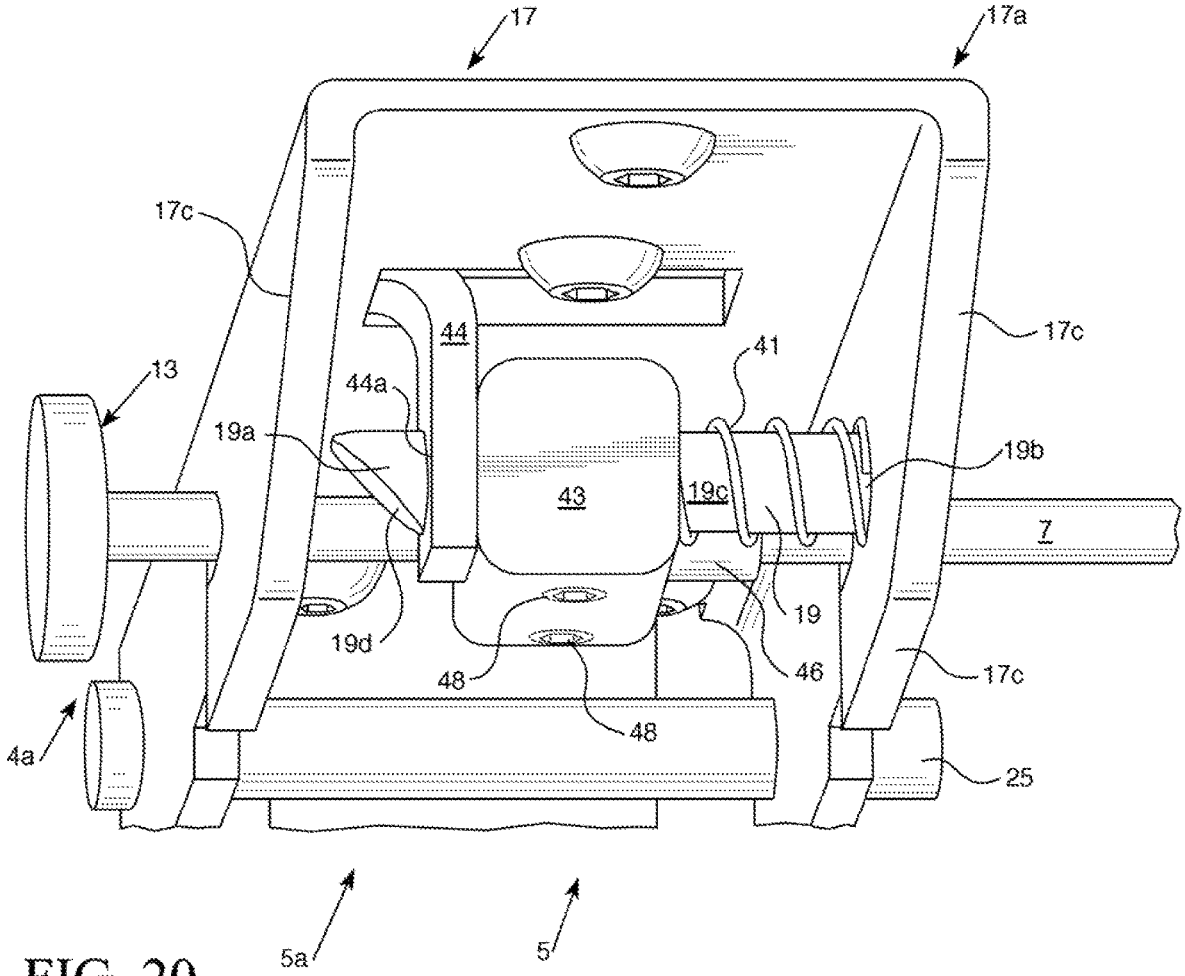
FIG. 20 is a fragmentary perspective view of an exemplary embodiment of the article of furniture illustrating components of a first flip connector 5*a* adjacent a first side of the work surface that has a guide 19 that includes a second end 19*b* that is shaped to define a ramped surface 19*d* while the work surface is in a flipped position.

The actuation member 43 can be connected to actuation member guide 19. In some embodiments, the guide 19 can be structured as a pin that has a distal end. The cross-sectional shape of the elongated body 19*c* of the guide 19 can be circular, oval, or polygonal shaped. The guide 19 can have opposite first and second ends about which the body of the guide 19 extends between along the length of the guide 19. A distal second end 19*b* of the guide 19 can be tapered (see e.g. FIGS. 20-22) or may be non-tapered (e.g. uniform in width and shaped in cross-section similar to the body of the guide between the first and second ends). The first end 19*a* of the guide 19 that is opposite its second end can have a same shape as the second end or may have a different shape (e.g. the first end can have a head that may be wider than the width of the body, or may have a flat or uniform width while the second end has a tapered shape of decreasing width or thickness along its length, etc.). The diameter or width of the body of the guide 19 and its first and second ends can be pre-selected to meet a particular design objective and to account for size, weight and force constraints associated with the design criteria for a particular embodiment.

The guide 19 can be connected between the actuation member 43 and the upper element 17*a* or the lower element 17*b*. In some embodiments, the actuation member 43 can include a guide aperture through which the guide passes. A first end of the guide can be held, retained or attached to a first side member attached to the lower element 17*b* or to the actuation member 43. The second end 19*b* of the guide 19 can be attached to a sidewall 17*c* of the upper element 17*a* or to a side member attached to the lower element 17*b*. The guide 19 can be positioned so that the actuation member 43 is moveable along a linear path defined by the length of the guide 19. The guide 19 can be structured and positioned to prevent the work surface 3 from being moved out of the work position unless a user applies a force to move an actuation member 43 that is moveable relative to the guide 19 and/or along the guide 19 to an unlocked position or unlocking position.

A biasing member 41 can be positioned on the guide 19. For instance, a coil spring can be a biasing member that is positioned on the guide member 19 so that the guide member extends through the central opening of the spring. In other embodiments, the spring of the biasing member can be an elastomeric tubular structure (e.g. cylindrical tube, polygonal cross-section shaped tubular structure, etc.) that is resiliently deformable along its length. In yet other embodiments, the biasing member can include another type of spring member.

The biasing member 41 can have a first end that is in contact with the actuation member 43 and a second end that is in contact with a portion of the upper element 17*a* or lower element 17*b* or other structure to which the second end 19*b* of the guide 19 is attached. For example, the biasing members opposite ends can contact the actuation member 43 and a sidewall 17*c* of the housing that is attached to the upper element 17*a* or lower element 17*b* and is opposite and spaced apart from the actuation member 43.

The biasing member 41 can be resiliently biased to an extended position. Movement of the actuation member 43 from an initial position (which can also be considered a locking position) to an unlocking position that may be driven by a force applied by a user that overcomes the biasing force of the biasing member 41 so that the biasing member 41 is compressed or resiliently flexed as the actuation member 43 is moved (e.g. moved along the guide 19 or moved closer toward a sidewall 17*c* to which the second end 19*b* of the guide 19 is adjacent) via the user applied force, or moved to accommodate motion of the actuation member along a portion of the guide 19 toward the unlocking position. When the user force is removed, the biasing member 41 can resiliently expand or decompress to drive motion of the actuation member from the unlocking position back to its initial position (e.g. move the actuation member 43 along guide 19 to its initial position, move the actuation member away from the sidewall 17*c* to which the second end 19*b* of the guide 19 is adjacent or positionable to the actuation member's initial position, etc.).

The user force can be applied by a user manipulating an actuator 13 (e.g. a knob, handle, lever, etc.) that may be connected to a distal end of the elongated member 7. The first end portion 7*a* of the elongated member can be connected to a first actuator 13*a* and the second end portion 7*b* of the elongated member 7 can be connected to a second actuator 13*b*. Each actuator 13 can be positioned adjacent an outer side of a respective flip connector 5 so that a user may readily manipulate the actuator 13 below a work surface 3 when the work surface 3 is in the work position. The flipping mechanism 4 can be configured so that the user can push the first actuator 13*a* adjacent the first side of the work surface to linearly move the elongated member 7 toward the second side surface of the work surface and also drive motion of the actuation member(s) 43 from their initial position to their unlocking position. The pushing force provided by the user can move the first actuator 13*a* from its initial position to a second position by moving the first actuator 13*a*, the elongated member 7, and actuation members 43 of the first and second flip connectors 5*a* and 5*b* toward a second side of the work surface. Such a force can also result in the elongated member 7 linearly moving from the first side of the work surface toward the second side of the work surface 3 as the actuation members 43 of the first and second flip connectors 5*a* and 5*b* move.

The second actuator 13*b* adjacent the second side of the work surface can be configured to be pulled (e.g. motion of the second actuator 13*b* from its initial position in a direction of the second side of the work surface to move the elongated member 7 toward the second side of the work surface) to drive motion of the actuation member(s) 43 from the initial position to the unlocking position. This pulling motion acted on the second actuator 13*b* can also result in the elongated member 7 also moving linearly toward the second side of the work surface via its attachment to the actuation member(s) 43 and second actuator 13*b*.

Each actuation member 43 can be attached to a structure or be configured to define a profile to facilitate motion from its initial position to is unlocking position and vice versa to help accommodate motion of the work surface 3 from its flipped position (e.g. second position) to its work position (e.g. first position) so that a user does not have to manipulate an actuator 13 to allow the work surface 3 to be returned from its flipped position to its work position and also does not have to manipulate an actuator 13 to lock the position of the work surface in its work position after tilting the work surface from its flipped position to its work position.

For example, the actuation member 43 for each flip connector 5 can include a first locking structure 47 or be attached to the first locking structure 47 that defines a first locking ramp 47*d* that extends linearly at an angle from an upper end 47*a* to a lower end 47*b*. The first locking ramp 47*d* can have a smooth surface to facilitate sliding motion of the first locking structure 47. The first locking structure 47 can have a top upper surface 47*c* that is positioned adjacent to a vertically extending wall portion 47*e* of the actuation member 43 to which it is attached (or to which it is integral). The guide 19 for each flip connector 5 can be connected to this wall portion 47*e* or adjacent the wall portion 47*e* of the actuation member 43. The first locking ramp 47*d* can extend from its top 47*a* to its bottom 47*b* at a pre-selected angle θ relative to horizontal. That angle θ at which the first locking ramp 47*d* extends from its top 47*a* to its bottom 47*b* can be in an angle in any of the following exemplary ranges: 15°-75°, 30°-60° or 25°-45°, for example.

Each flip connector 5 that houses an actuation member 43 can include a second locking structure 57 that has a second locking ramp 57*d* that linearly extends from its bottom 57*b* to its top 57*a* at a pre-selected angle φ to cooperate with the first locking ramp 47*d*. The pre-selected angle can be in an angle in any of the following exemplary ranges: 15°-75°, 30°-60° or 25°-45°, for example. The angle for the second locking ramp 57*d* can correspond to the angle of the first locking ramp 47*d* such that the first locking ramp 47*d* is slideable along the second locking ramp 57*d*. In some embodiments, the angle at which the first locking ramp 47*d* extends from its top 47*a* to its bottom 47*b* is the same as the angle at which the second locking ramp 57*d* extends from its bottom 57*b* to its top 57*a*. The bottom 57*b* of the second locking ramp 57*d* can be configured so that the second locking structure has a lower projecting portion 57*c* that extends from a body of the second locking structure 57 to the bottom 57*b* of the second locking ramp 57*d*. The extent to which this lower portion 57*c* extends can be selected to lockingly receive the first locking structure 47 so that the top 47*c* of the first locking structure 47 can slide along the projecting portion 57*c* that extends from a body of the second locking structure 57 to which the second locking ramp 57*d* is integral or is otherwise attached.

The cooperative first and second locking ramps 47*d* and 57*d* can be configured to facilitate contacting of the second locking structure 57 to the first locking structure 47 when the work surface 3 is moved from its flipped position to its work position so that the actuation member 43 is automatically driven via the downward motion of the work surface along the path defined by the first and second locking ramps 47 and 57 toward its unlocking position as the work surface is moved to its work position. Once the work surface is at its work position, the top upper surface 47*c* of the first locking structure 47 can be positioned below the bottom 57*b* of the second locking ramp 57*d* adjacent the lower projecting portion 57*c* that projects outwardly from the second locking structure 57 to the bottom of the second locking ramp 57*d* so that the biasing force of the biasing member 41 can drive the actuation member toward its initial position. For instance, the lower projecting portion 57*c* of the second locking structure can be configured to facilitate motion of the actuation member 43 from its unlocking position to its initial, locked, position via motion of the biasing member 41. The top 47*c* of the first locking structure 47 can be configured to cooperate with the lower projecting portion 57*c* of the second locking member 57 so the top 47*c* of the first locking structure 47 slides along the lower projecting portion 57*c* that extends to the bottom 57*b* of the second locking ramp 57*d* as the actuation member 43 is moved to its initial position via the biasing member 41. In some embodiments, the lower projecting portion 57*c* of the second locking structure 57 can also function to retain (or help retain) the actuation member 43 in its initial position and prevent the work surface 3 from being moved out of the work position unless a user applies a force to move the actuation member 43 from its initial position to its unlocking position. Such a motion of the actuation member causes the first locking structure 47 to slide away from the second locking structure 57 so that the top 47*c* of the first locking structure is no longer in contact with the lower projecting portion 57*c*, which allows the first locking ramp 47*d* to then be slideable along the second locking ramp 57*d* as the work surface is moved from its work position to its flipped position. The first locking structure 47 being moved away from the second locking structure 57 so it is slideable along the second locking ramp 57*d* can be a position that the first locking structure 47 is in when the actuation member 43 is in its unlocking position as such movement of the first locking structure 47 can unlock the working surface and permit movement of the work surface 3 from the work position to the flipped position. During such motion of the work surface from the work position to the flipped position, the first locking ramp 47*d* can contact and slide along the second locking ramp 57*d* during at least the initial portion of the motion of the work surface from its work position to its flipped position.

In other embodiments, the actuation member 43 can have a different configuration and not utilize a first locking ramp 47*d*. In such embodiments, the second locking structure 57 of the flip connector 5 may also not be included (e.g. the cooperative first and second locking ramps 47*d* and 57*d* may not be present). For example, in some embodiments, the guide 19 can be configured so its distal first end 19*a* is tapered to define a slanted tip that is shaped to define a lower ramp surface 19*d*. The lower ramp surface can have an upper height at the distal tip end of the first end 19*a* of the guide 19 and a bottom inward from the distal tip end that is lower than the upper height at the distal end. The thickness of the guide at its distal tip of the first end 19*a* can be less than the thickness at the more inward bottom of the lower ramp surface 19*d*.

In some embodiments, the lower ramp surface 19*d* can extend inwardly and downwardly at an angle of between 15°-75°, 30°-60°, or 40°-50° relative to horizontal from the distal tip of the first end 19*a* to a lower inner location on the guide 19 that is closer to the actuation member 43 as compared to the distal tip of the first end 19*a*. Such a guide 19 can be utilized in the first and second flip connectors 5*a* and 5*b* as can be appreciated from FIGS. 20-22, for example.

In embodiments utilizing the guide 19 having the lower ramp surface 19*d*, the actuation member 43 for each flip connector 5 can include a first passageway through which a portion of the elongated member 7 extends through and a second passageway through which a portion of the guide 19 extends through. A sleeve 46 can extend from the actuation member 43 that is integral to the actuation member 43 and aligned with the first passageway. The elongated member 7 can also pass through the inner conduit of this sleeve, which can also be considered a part of the first passageway defined by the actuation member 43 in embodiments in which the sleeve is integral to the actuation member 43 or otherwise affixed to the actuation member 43. The elongated member 7 can have an interference fit in the first passageway so that motion of the elongated member 7 also causes the actuation member 43 to move in the same direction as the elongated member 7 with the motion of the elongated member 7.

In some embodiments, a set screw 48 can also be passed into the actuation member 43 to contact the elongated member 7 within the first passageway to help retain the elongated member 7 therein and to provide the interference fit between the elongated member and the actuation member. The sleeve 46 can be sized and configured to function as a stopper to contact an internal surface of the sidewall 17*c* so the distal tip portion of the first end 19*a* of the guide 19 is able to contact a portion of the component 42 adjacent opening 42*a* when the actuation member 43 is moved out of its initial position and moved to an unlocked position (e.g. the sleeve can help ensure that the distal tip portion of the first end slides along the components 42*a* adjacent an outer wall that helps define the opening 42*a* and does not fully pass out of opening 44*a* of component 44 that extends from the upper element 17*a* of the housing 17, etc.). In other embodiments, the sleeve 46 can be sized and positioned to help define the path of travel of the guide 19 and actuation member 43 between initial and unlocking positions in which the first end 19*a* of the guide 19 is able to be fully moved out of opening 42*a* and away from the component 42 (e.g. there is no sliding or contact between the guide 19 and the component 42 when the work surface is flipped into its flipped, or tilted, position, etc.).

The biasing member 41 can extend from a side of the actuation member 43 and an inner side of a sidewall 17*c* attached to an upper element 17*a* of the housing or a lower element 17*b* of the housing. The portion of the guide 19 between the sidewall 17*c* and the actuation member 43 can be within an inner channel of the biasing member 41 (e.g. within the inner conduit of a coil spring, etc.). The guide 19 can extend from the sidewall 17*c* through the actuation member 43 and through aligned openings 42*a* and 44*a* of components 42, 44 of the lower element 17*b* and upper element 17*a* of the housing 17.

Figure 21:
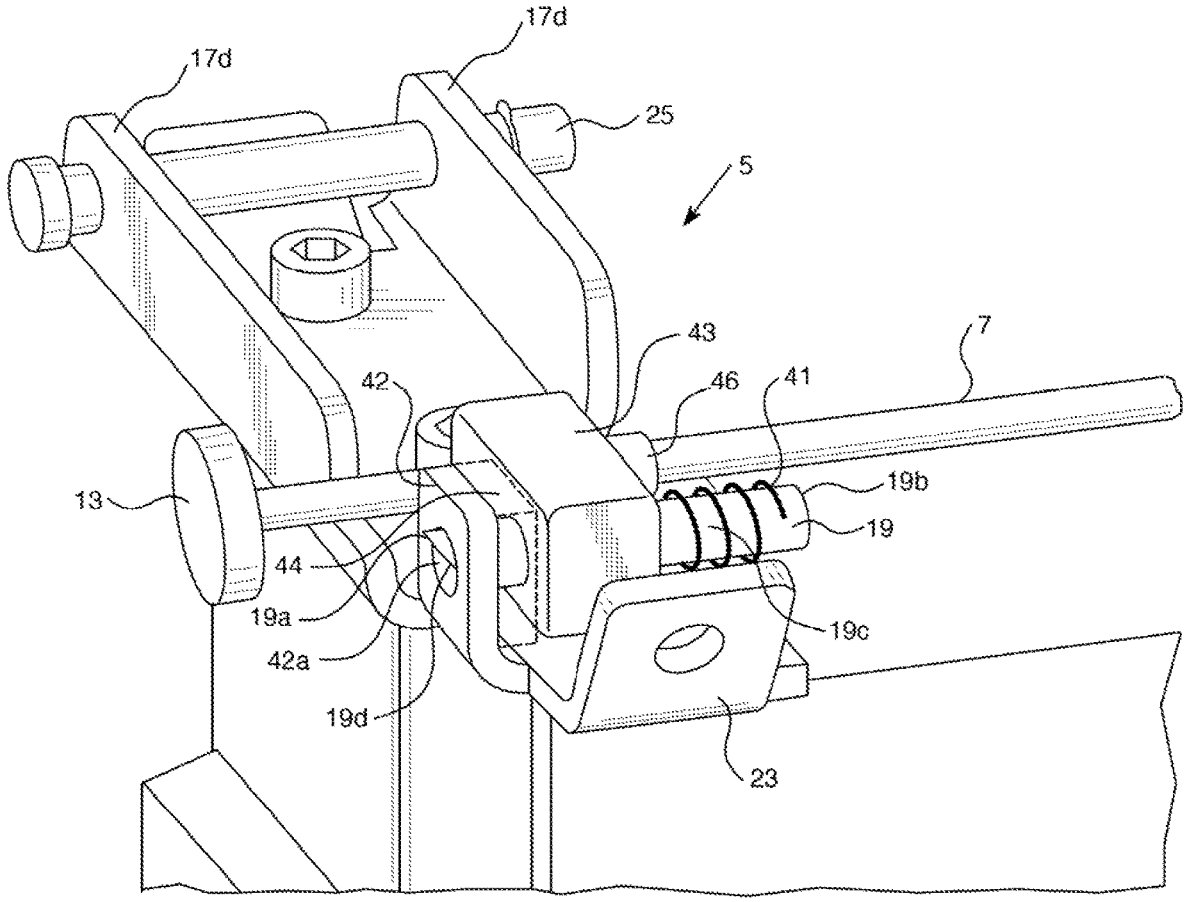
FIG. 21 is a fragmentary perspective view of the exemplary embodiment of the article of furniture similar to FIG. 20 with portions of the upper element 17*a* of a housing 17 removed to better illustrate features of the first flip connector 5*a* while the work surface is in work position and the guide 19 is in an initial position.
Figure 22:
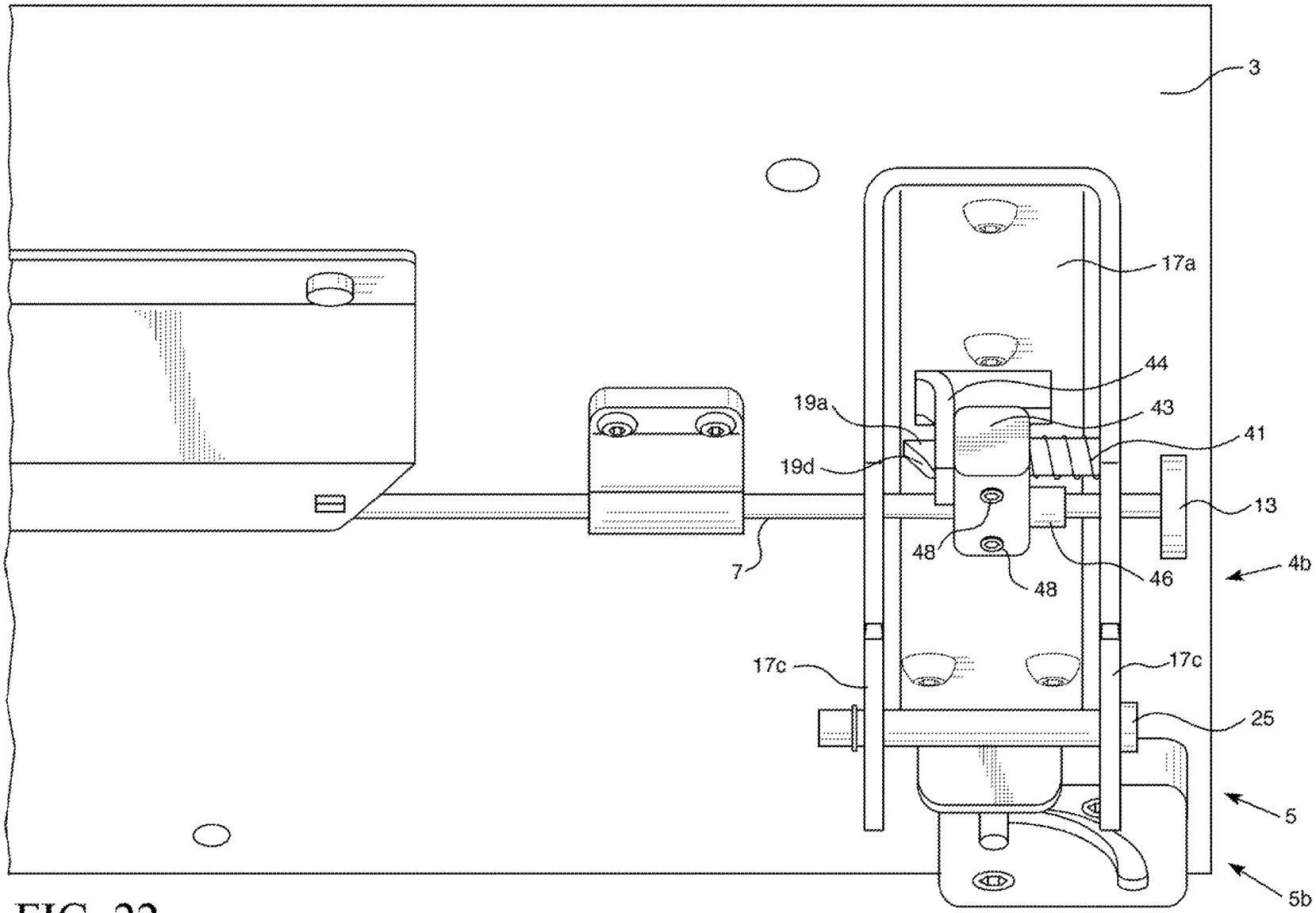
FIG. 22 is a fragmentary perspective view of the exemplary embodiment of the article of furniture shown in FIGS. 20-21 illustrating components of the second flip connector 5*b* adjacent a second side of the work surface that has a guide 19 that includes a second end 19*b* that is shaped to define a ramped surface 19*d* while the work surface is in a tilted position.

In FIG. 21, component 44 is represented in phantom line to illustrate an exemplary alignment and positioning of components 42 and 44 and an exemplary arrangement in which the guide 19 can extend through the aligned openings 42*a* and 44*a*. The remaining portions of the upper element 17*a* of the housing is removed from FIG. 21 to help better illustrate this particular arrangement in the initial position of the guide 19.

The guide 19 can be attached to the actuation member 43 via a set screw 48 that extends into the actuation member to contact a portion of the guide 19 in some embodiment so that motion of the actuation member 43 also results in the guide 19 moving relative to the sidewall 17*c* (e.g. moving linearly through a hole of the sidewall 17*c* through which it extends). The extent of motion of the guide 19 can be limited by the path of travel of the actuation member 43 that can be moveable along a portion of the guide 19 between sidewall 17*c* and component 44 or component 42 (e.g. the distance by which the sidewall 17*c* is spaced from component 44 or component 42 can define the maximal path of travel for guide 19 and actuation member 43).

Figure 3:
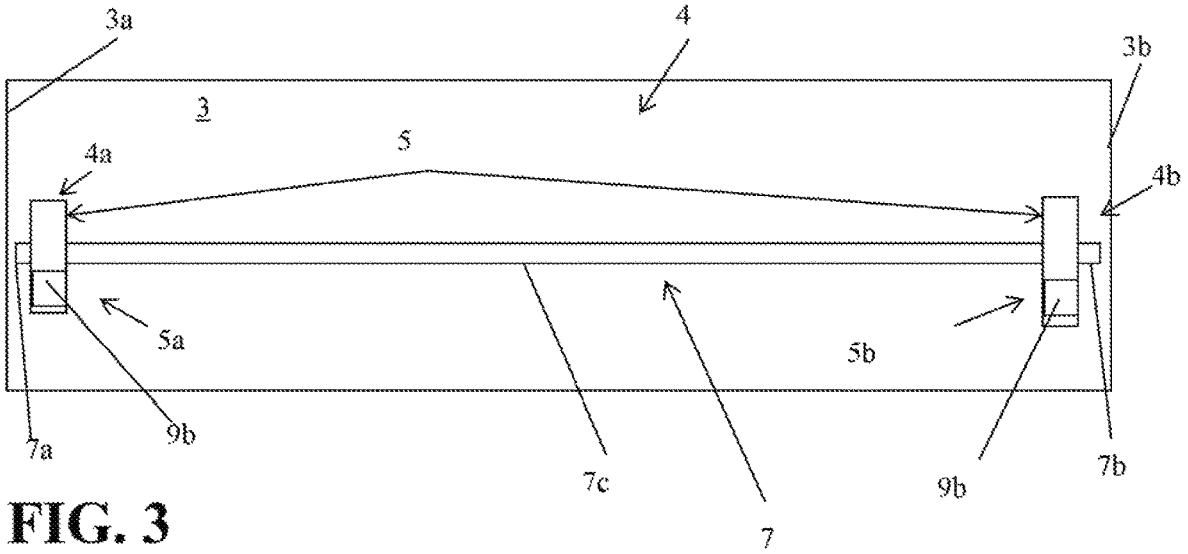
FIG. 3 is a bottom schematic view with the feet 9*c* and cross bar 9*a* of the base 9 of the article removed to better illustrate the exemplary embodiment of the flipping mechanism included in the first exemplary embodiment of the article of furniture shown in FIGS. 1 and 2.
Figure 4:
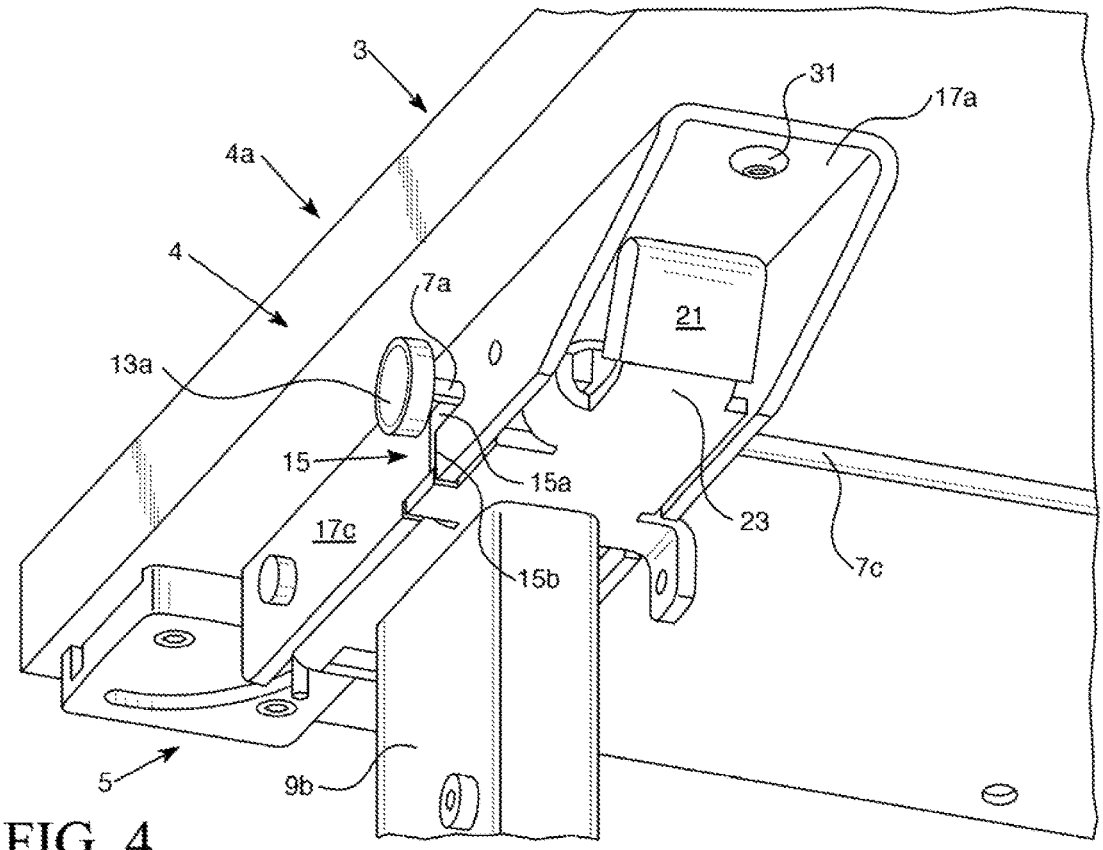
FIG. 4 is a fragmentary perspective view of the first exemplary embodiment of the article of furniture illustrating a component of the flipping mechanism in a non-flipped position.
Figure 5:
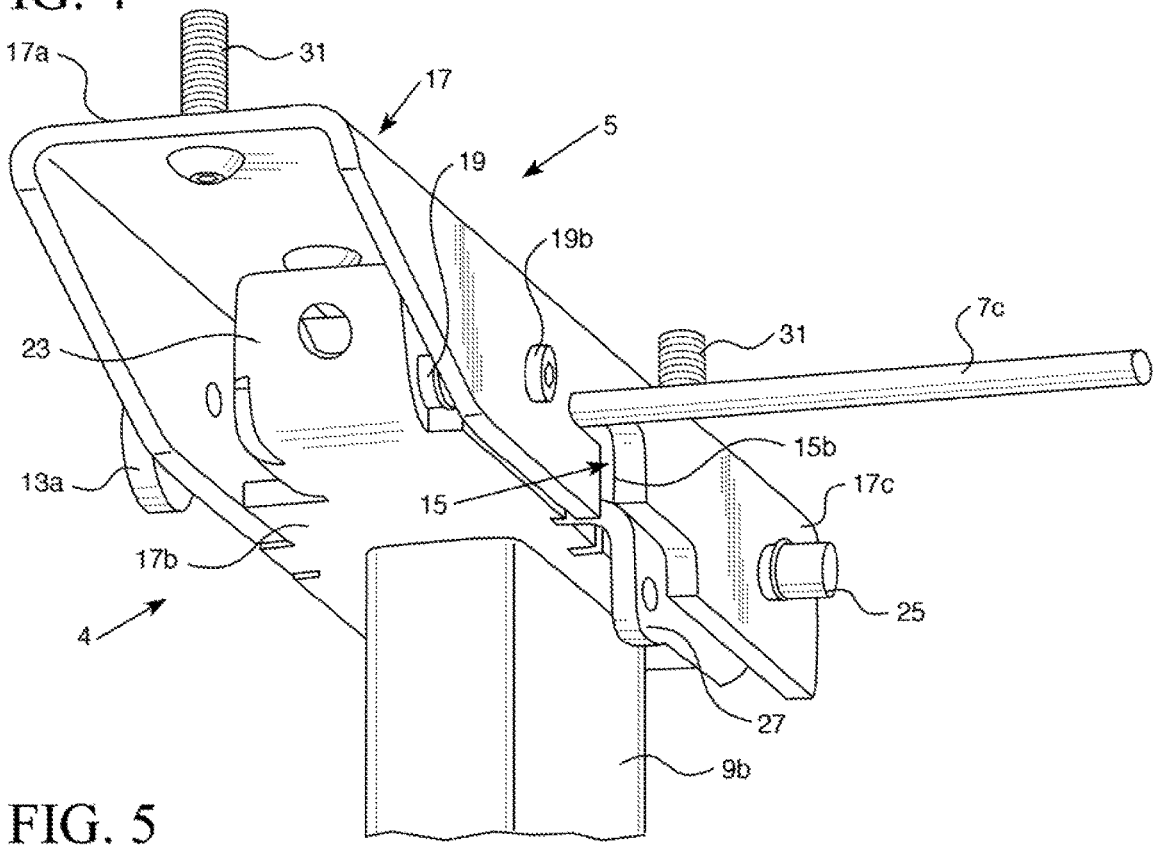
FIG. 5 is fragmentary perspective view of the first exemplary embodiment of the article of furniture similar to FIG. 4 illustrating a component of the flipping mechanism in the non-flipped position.
Figure 6:
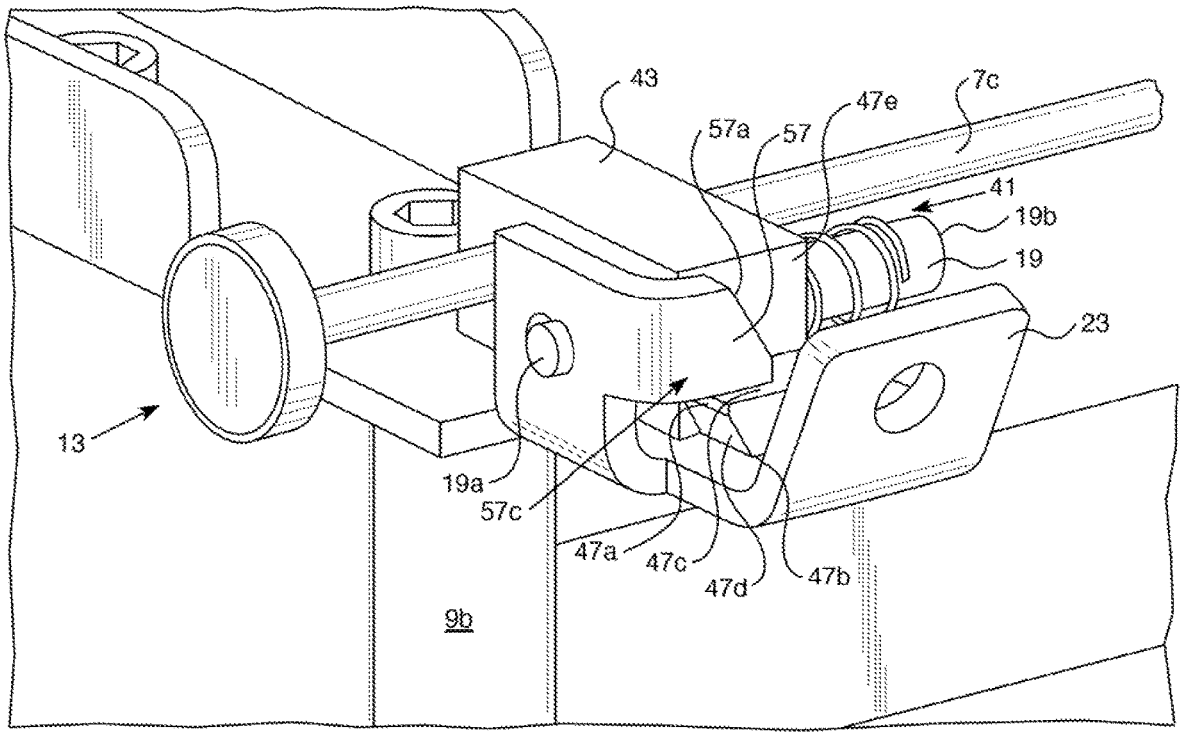
FIG. 6 is fragmentary perspective view of the first exemplary embodiment of the article of furniture similar to FIGS. 4 and 5 with the upper element 17*a* cut away to illustrate the attachment between the elongated member 7 and an actuation block 43 while the work surface is in the non-flipped position (e.g. a work position).
Figure 7:
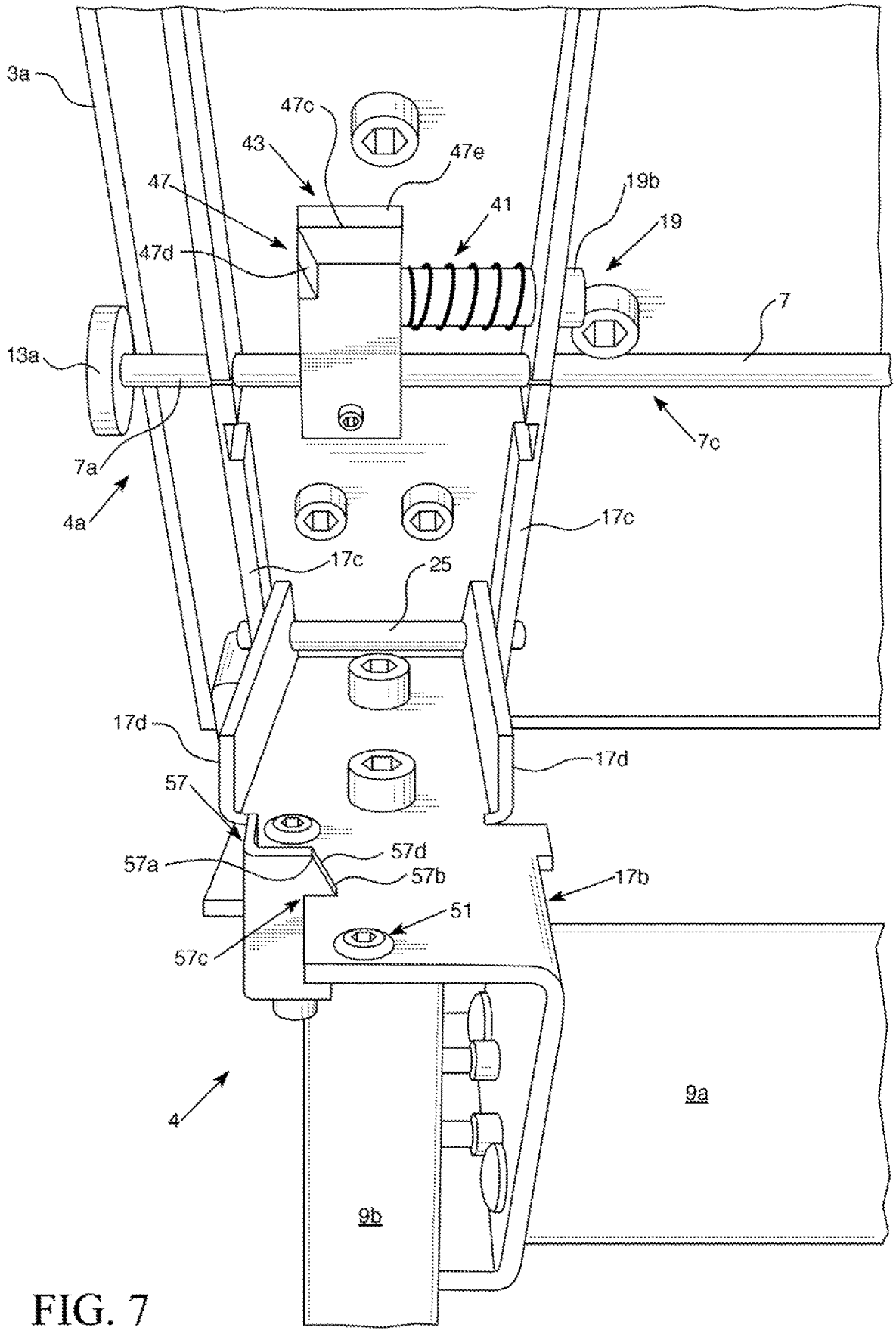
FIG. 7 is fragmentary perspective view of the first exemplary embodiment of the article of furniture similar to Figures illustrating a component of the flipping mechanism in a flipped position.
Figure 8:
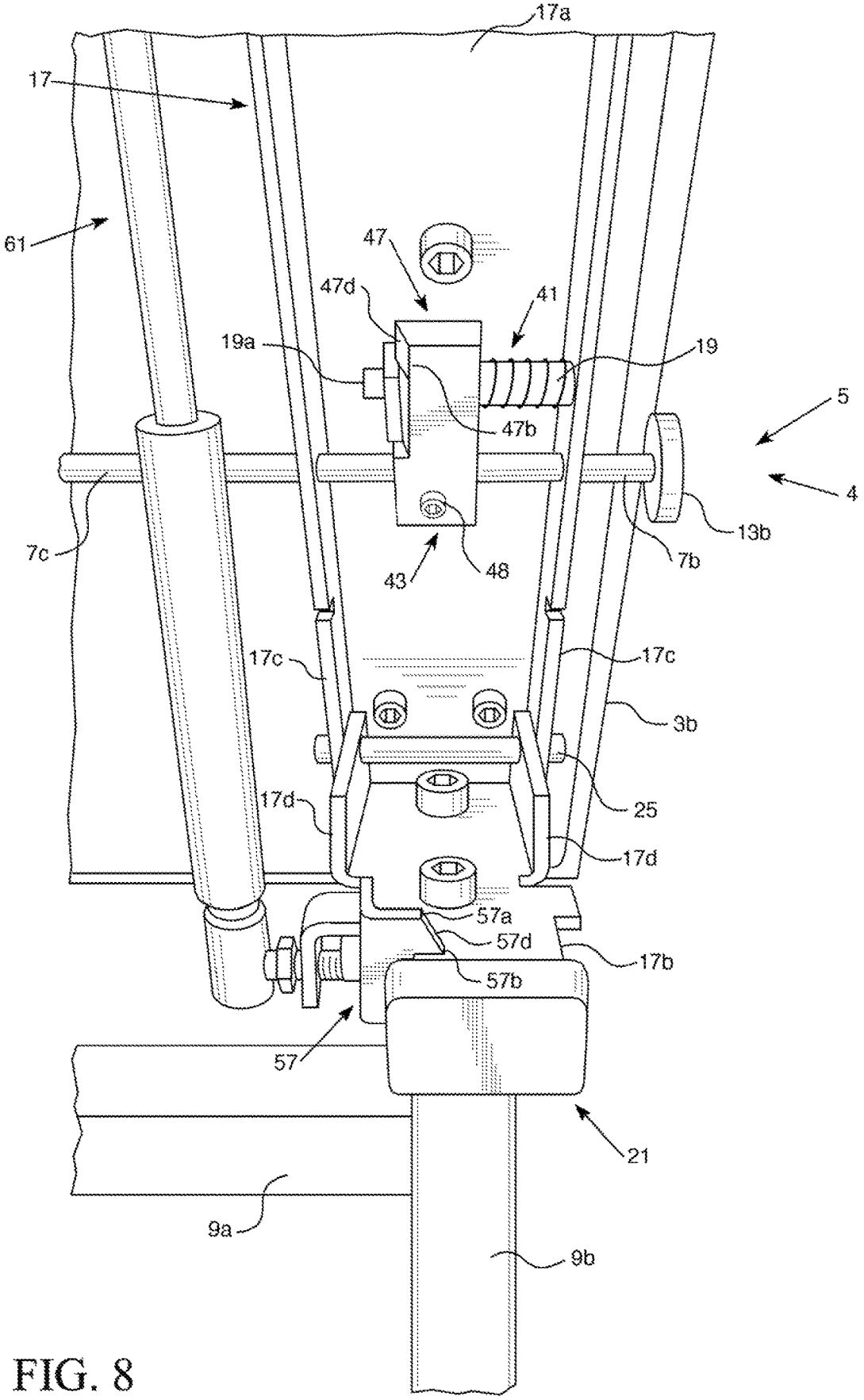
FIG. 8 is fragmentary perspective view of the first exemplary embodiment of the article of furniture illustrating a component of the flipping mechanism in a flipped position.
Figure 9:
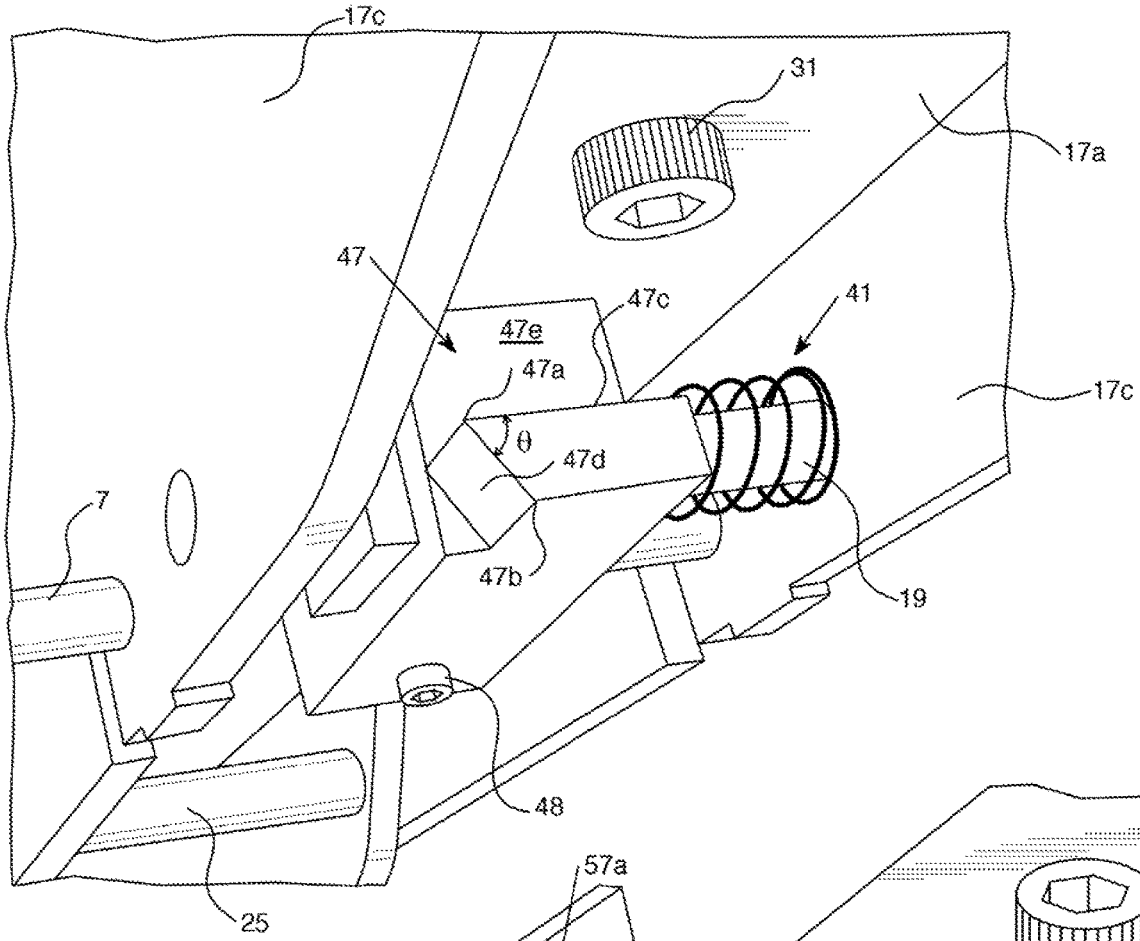
FIG. 9 is an enlarged fragmentary view of a first latch interlock element of the flipping mechanism for the flip connectors 5 of the first exemplary embodiment of the article of furniture.
Figure 10:
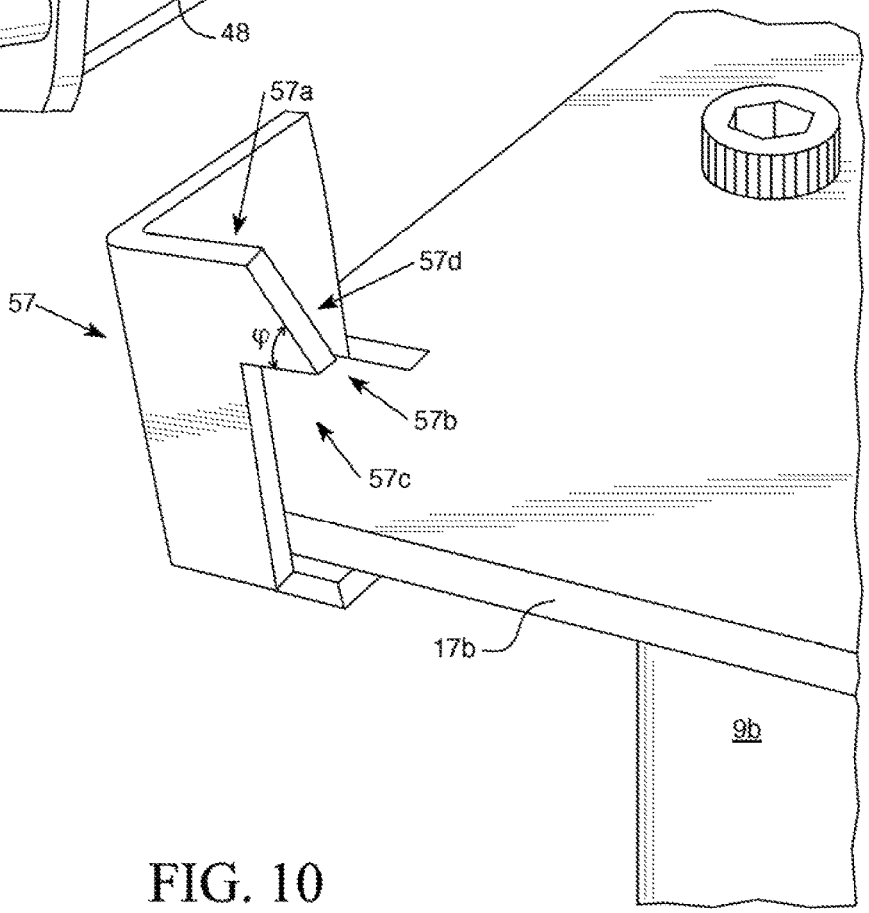
FIG. 10 is an enlarged fragmentary view of a second latch interlock element of the flipping mechanism for the flip connectors 5 of the first exemplary embodiment of the article of furniture.
Figure 11:
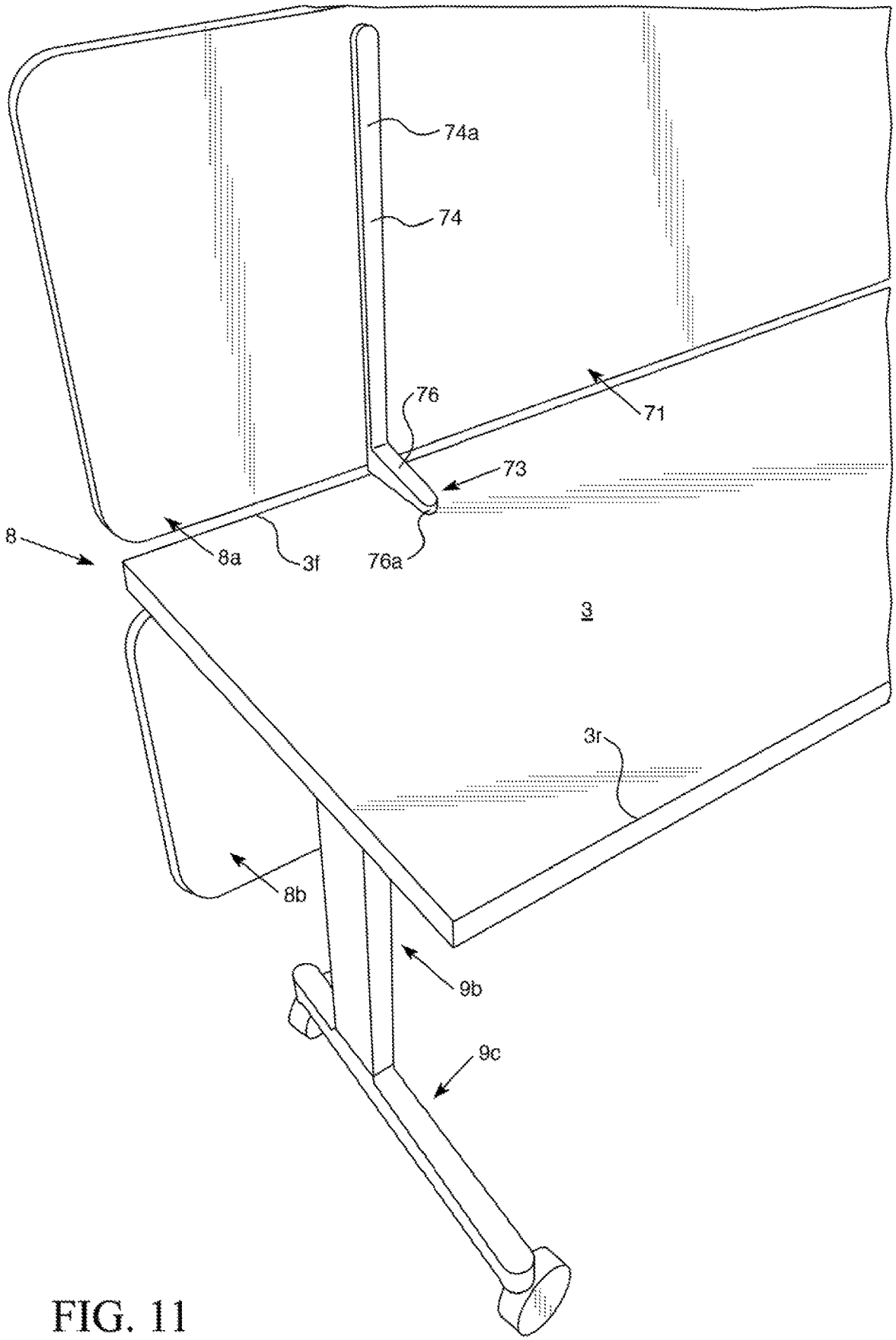
FIG. 11 is a perspective view of the first exemplary embodiment of the article of furniture with an exemplary embodiment of a privacy screen apparatus 8 connected thereto.
Figure 12:
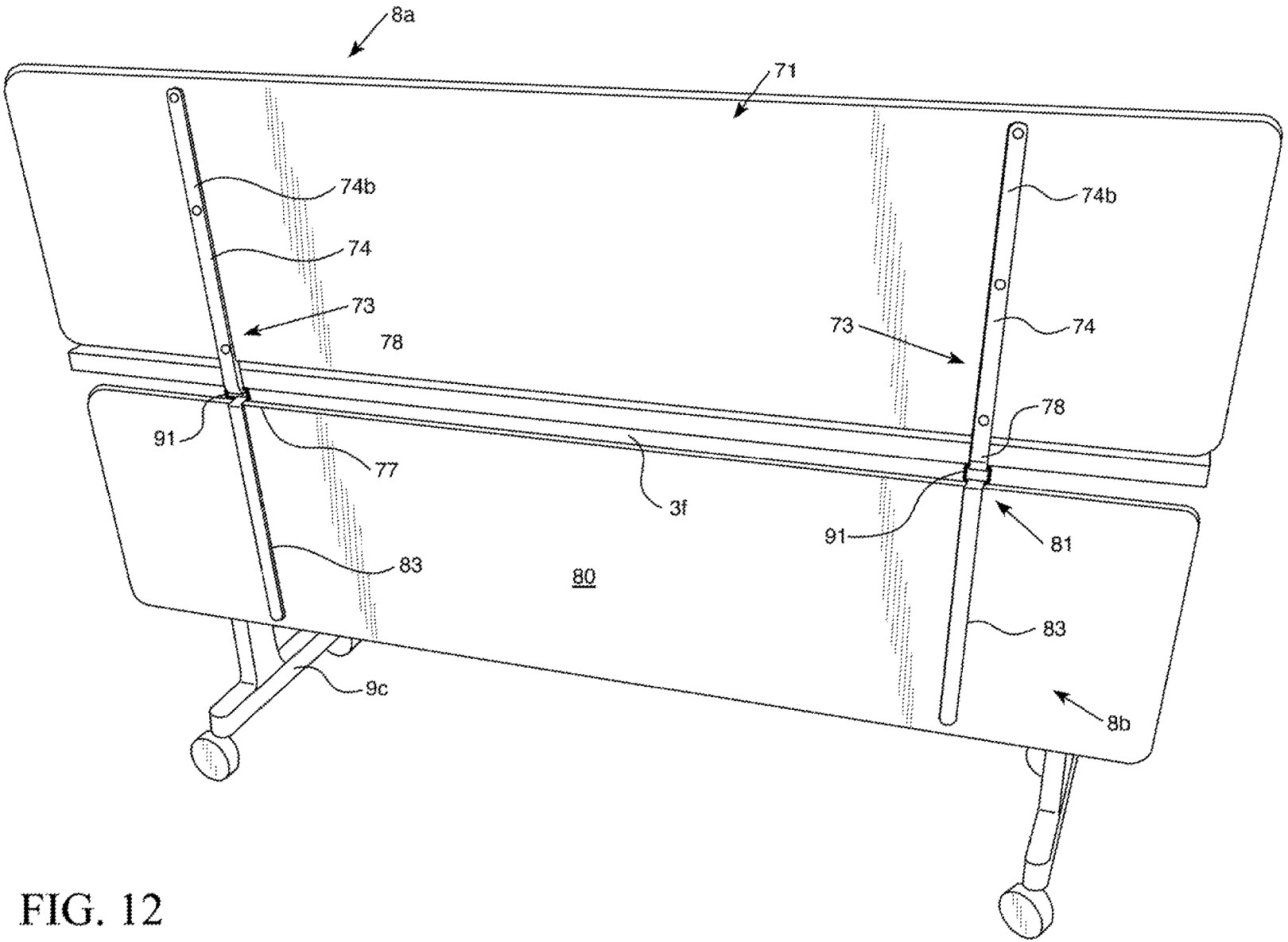
FIG. 12 is a perspective view of the first exemplary embodiment of the article of furniture with the exemplary embodiment of the privacy screen apparatus 8 connected thereto.
Figure 13:
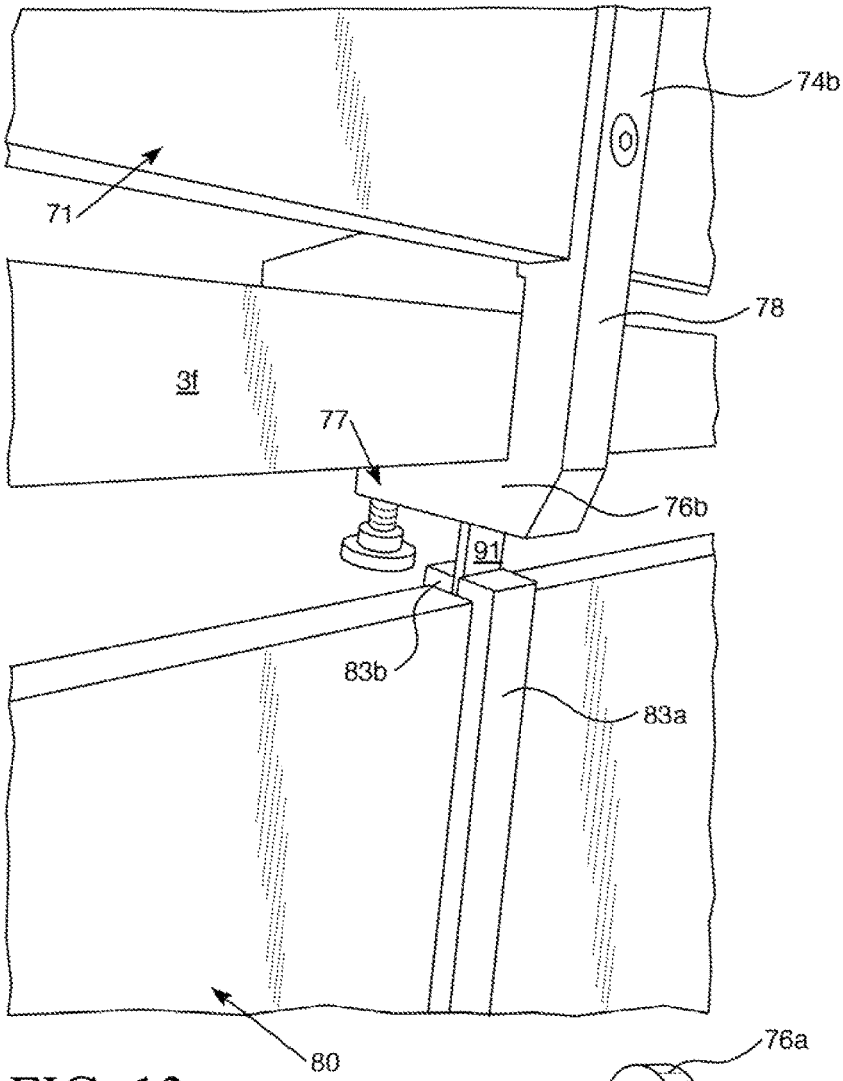
FIG. 13 is an enlarged fragmentary view of the first exemplary embodiment of the article of furniture with the exemplary embodiment of the privacy screen apparatus 8 connected thereto to illustrate an exemplary connection mechanism for the privacy screen apparatus 8.
Figure 14:
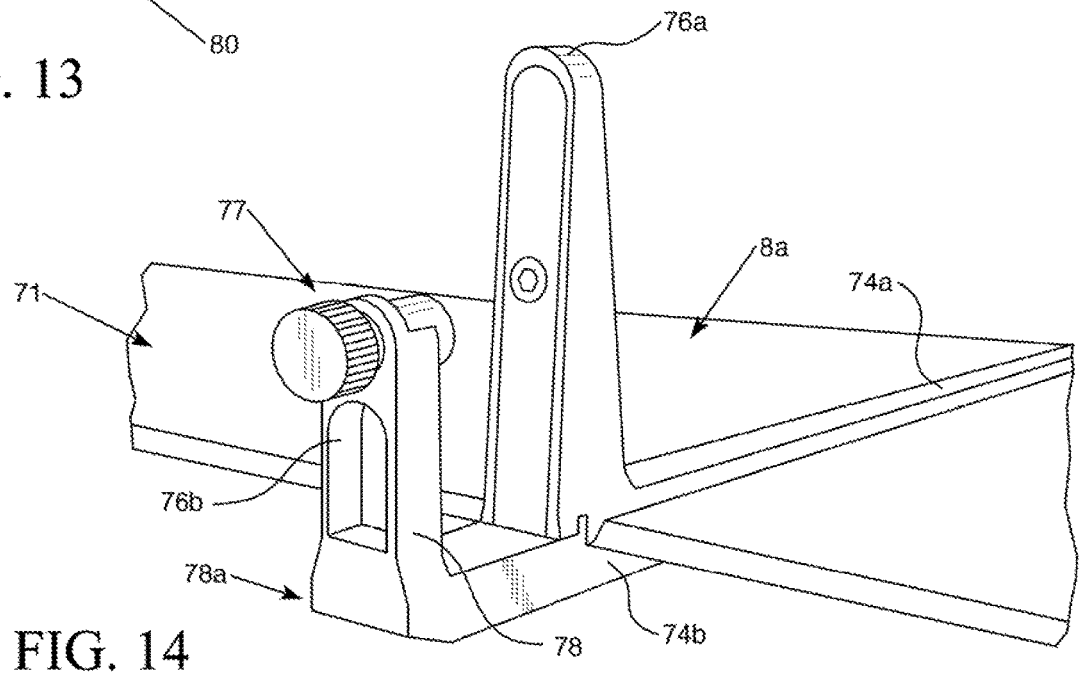
FIG. 14 is a perspective of an exemplary connection mechanism for the privacy screen apparatus 8 shown in FIG. 13.
Figure 15:
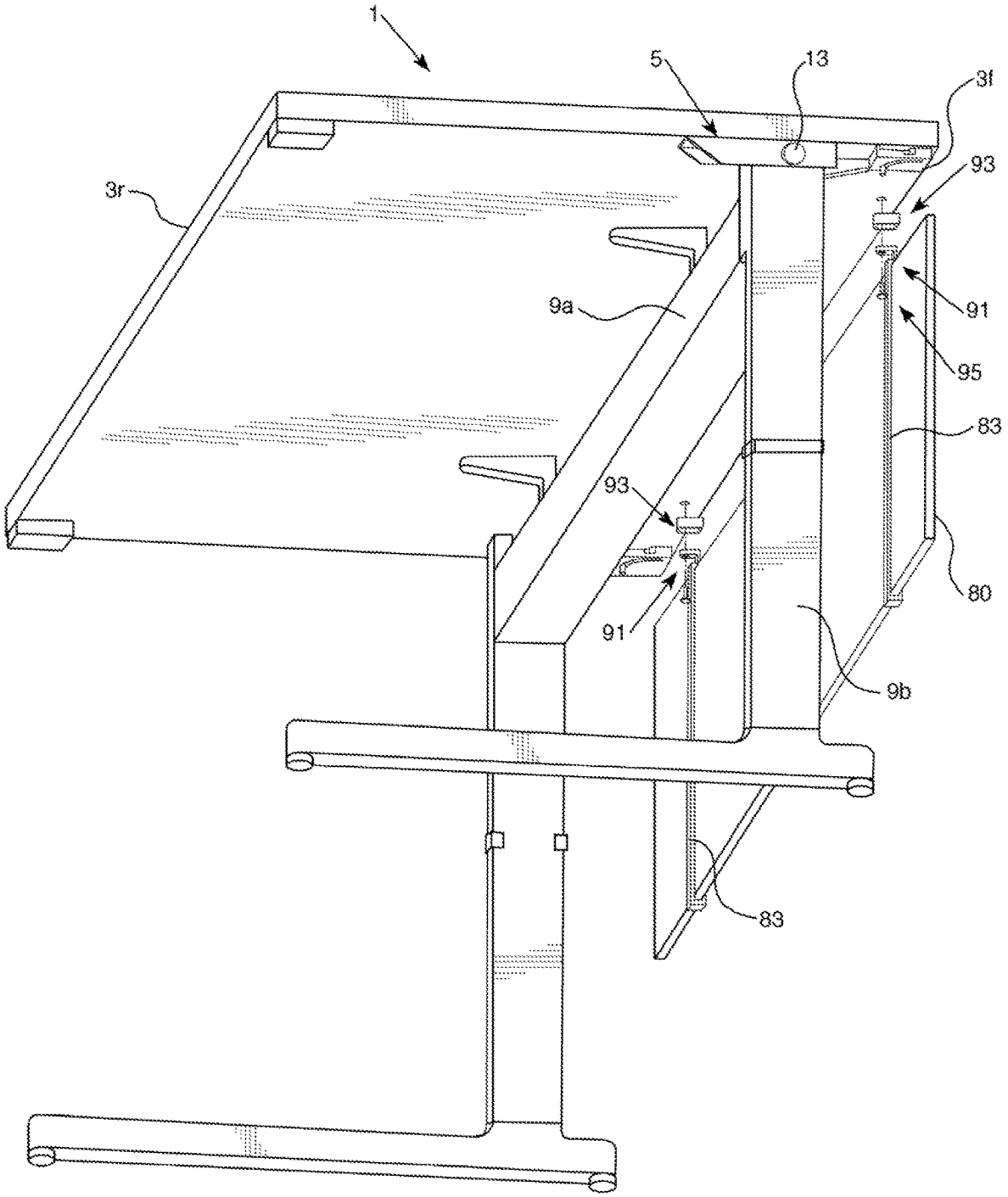
FIG. 15 is a perspective view of the first exemplary embodiment of the article of furniture with an exemplary embodiment of a privacy screen apparatus 8 connected thereto.
Figure 16:
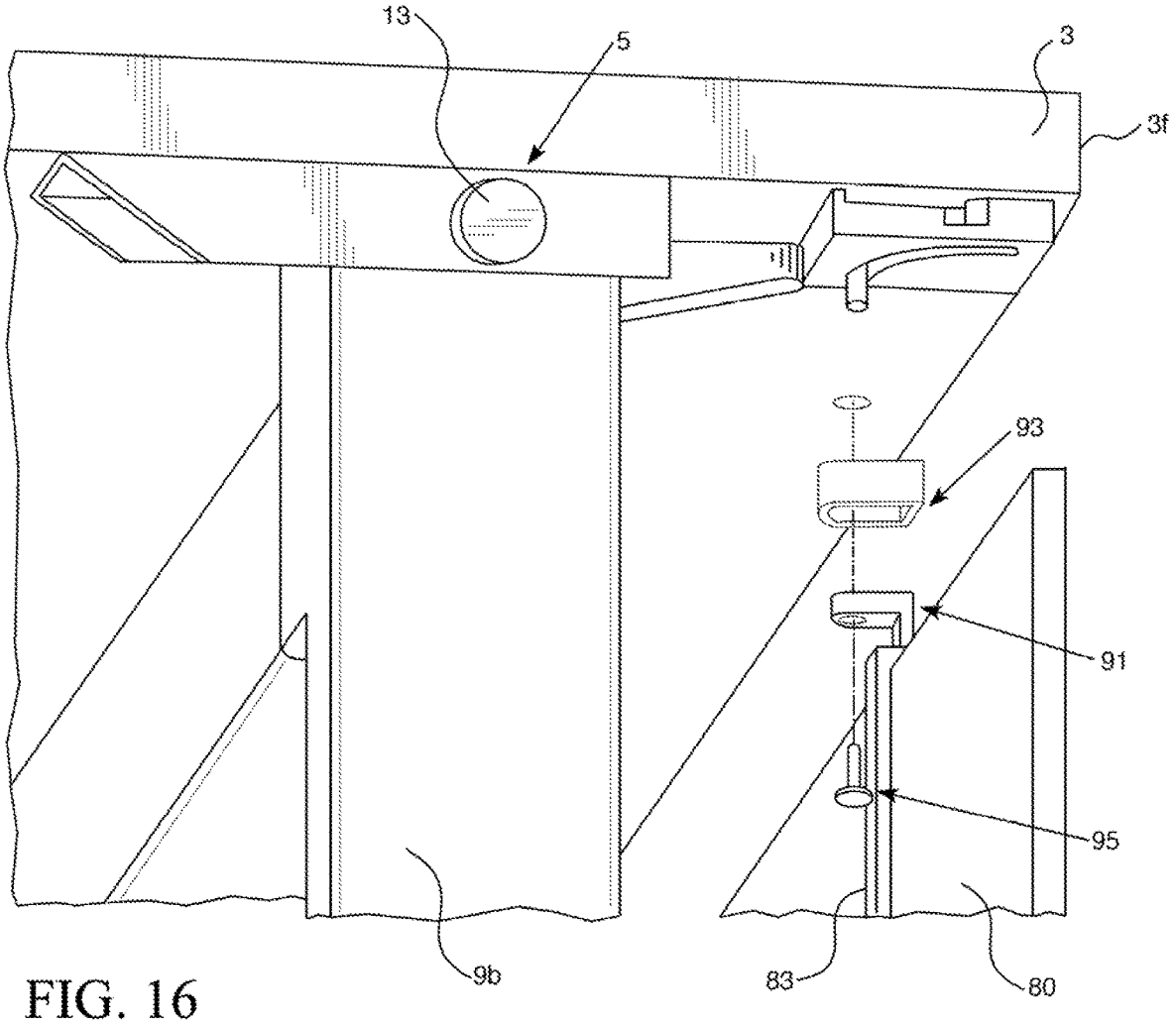
FIG. 16 is a fragmentary exploded view of the first exemplary embodiment of the article of furniture with an exemplary embodiment of a privacy screen apparatus 8 connected thereto to illustrate a second connection mechanism for the privacy screen apparatus.
Figure 17:
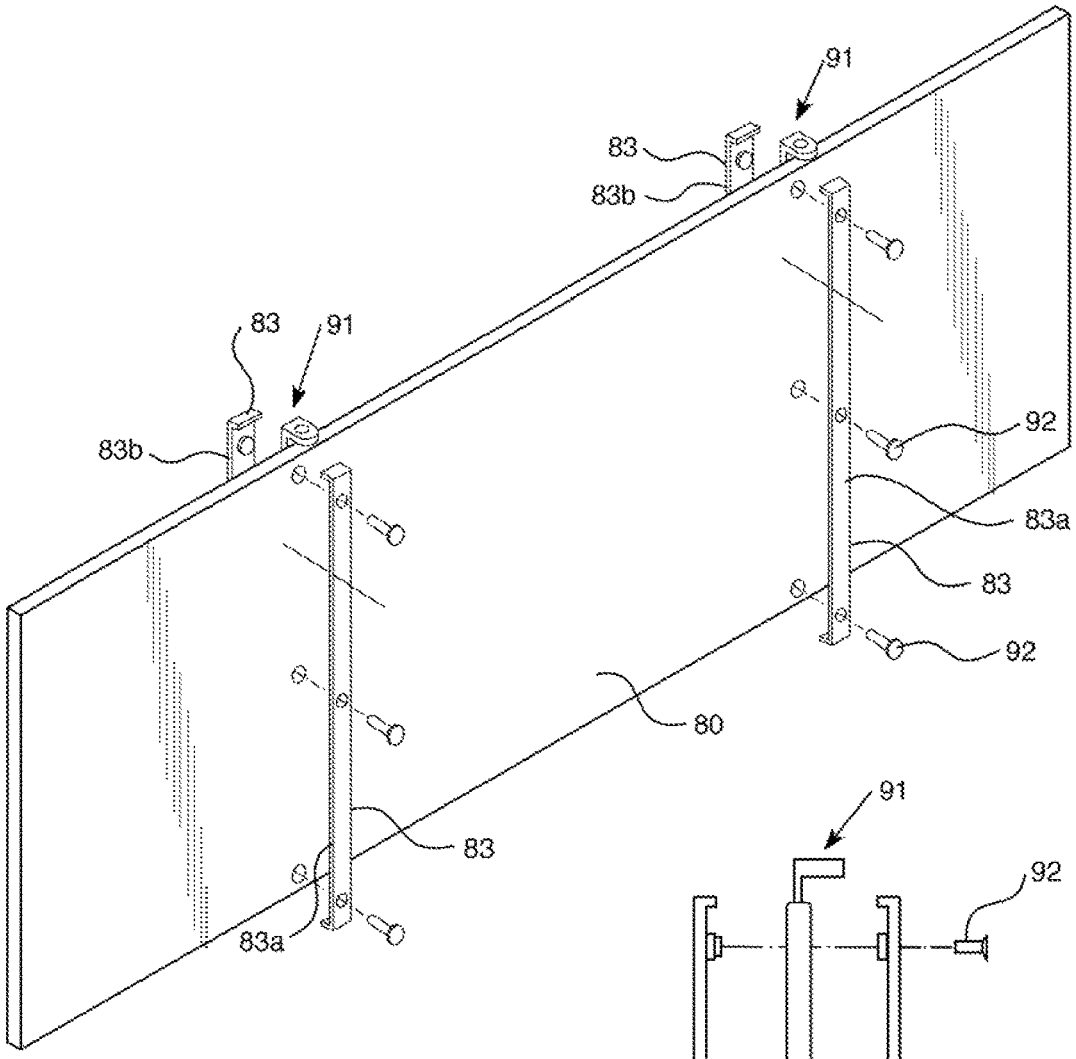
FIG. 17 is an exploded perspective view of the exemplary embodiment of the privacy screen apparatus 8.
Figure 19:
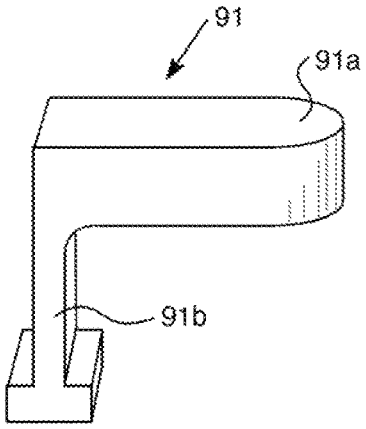
FIG. 19 is a perspective view of an elastomeric connector 91 of the exemplary embodiment of the privacy screen apparatus 8.
Figure 18:
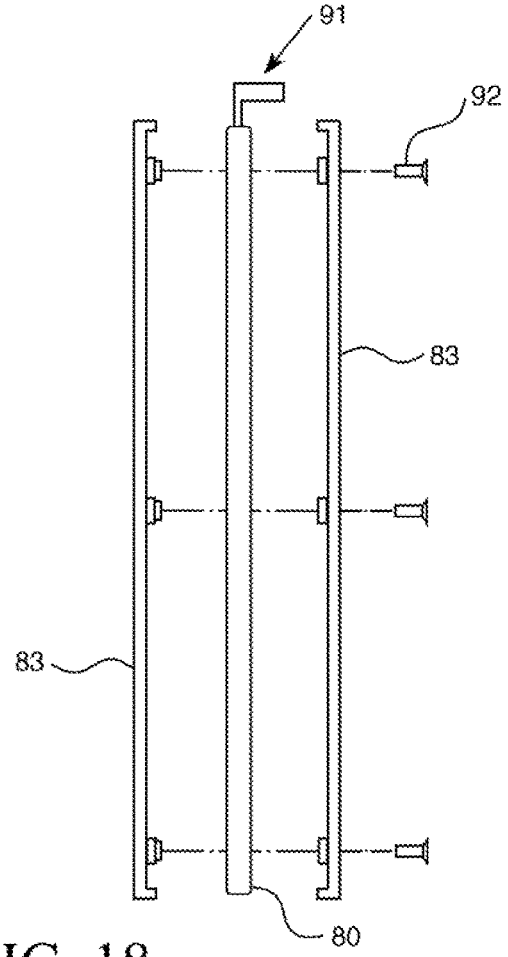
FIG. 18 is an exploded side view of the exemplary embodiment of the privacy screen apparatus 8.

As shown in FIG. 1-3, the flipping mechanism 4 can include first and second flip connectors 5*a*, 5*b* adjacent opposite first and second sides of a work surface 3. Each flip connector 5 can have the lower ramped guide 19 arrangement. The guide 19 and actuation member 43 for each flip connector 5 in such embodiments can be arranged so that the guide 19 moves away from the component 42 of the lower elongated element 17*b* of the housing to unlock the upper element 17*a* and permit flipping of the work surface when the elongated member 7 is moved via pushing or pulling of an actuator 13. Such motion can occur when a user pushes the first actuator 13*a* adjacent the first side of the work surface to drive motion of the actuation members 43 from their initial position to their unlocking position. The pushing force provided by the user can move the first actuator 13*a* from its initial position to a second position by moving the actuator 13*a*, elongated member 7, and actuation member 43 toward the second side of the work surface. Such a force can also result in the guides 19 of the flip connectors 5 linearly moving with the actuation member 43 to which it is connected when the actuation member 43 moves.

The second actuator 13*b* adjacent the second side of the work surface can be configured to be pulled (e.g. motion of the second actuator 13*b* from its initial position toward a second side of the work surface) to drive motion of the actuation members 43 from the initial position to the unlocking position. This pulling motion acting on the second actuator 13*b* can also result in the elongated member 7, actuation members 43 and guides 19 also moving linearly toward the second side of the work surface via their operative connection to the second actuator 13*b* for such embodiments (e.g. via the elongated member's connection to the actuation members 43 and the actuation members' connection to respective guides 19).

After the work surface 3 is flipped and the actuator 13 is released by a user, the biasing members 41 can act on the actuation members 43 to cause the actuation members 43 to move back to their initial position. This also results in the elongated member 7 and guides 19 moving simultaneously with the actuation members 43 to return to their original, initial positions.

When the work surface 3 is moved from its flipped position to its work position to return the work surface to its work position, the lower ramped surfaces 19*d* of the guides can be configured to contact the top of the component 42 of the lower elements 17*b* of the housing to automatically move the actuation members 43, guides 19, and elongated member 7 to an unlocked position. The angle and shape of the ramped surfaces 19*d* will affect the guide 19 by causing the guide 19 to move toward the second side of the work surface in response to the lower ramped surfaces 19*d* contacting the tops of the components 42 of the lower elongated elements 17*b* of the flip connectors 5. The distal tips of the first ends 19*a* of the guides 19 may contact inner sides of the component 42 as the work surface 3 moves to its work position. When the guides 19 are aligned with the openings 42*a* of the components 42, the biasing force of the biasing members 41 causes the actuation members 43, elongated member 7, and guides 19 to move in a direction toward the first side of the work surface to return to their initial positions as there is no longer a force counteracting the biasing force provided by the biasing members 43 via the structure of the components 42*a*. This arrangement of the flip connectors 5 can function to automatically self-lock the work surface 3 in its work position so a user does not have to manipulate an actuator to lock the work surface in its work position.

Some work surfaces 3 can be sized and configured such that they are relatively heavy. At least one gas spring 61 can be attached between a flip connector 5 and the bottom of the work surface 3. A first end of the gas spring 61 can be connected to the lower element 17*b* and the other end of the gas spring 61 can be connected to the bottom of the work surface 3, the upper element 17*a* or a sidewall 17*c* that extends from the upper element 17*a*. The extendable arm of the gas spring can extend when the work surface is flipped to its flipped position and retract when the work surface is moved from its flipped position to its work position. The gas spring 61 can be configured to provide a force to keep the work surface 3 in the flipped position, or tilted position that may be used for nesting of multiple articles of furniture. The gas spring 61 can also act as a damper so that the work surface 3 cannot move solely due to gravity at a high velocity during the motion of the work surface from its flipped position to its work position. This can help avoid a user being injured from a fast moving work surface. The force providable by the gas spring can also require a user to provide a sufficient downward force on the work surface 3 to overcome the dampening force provided by the gas spring 61 to cause the motion of the work surface from its flipped position to its work position. Requiring such added force can provide an additional safeguard to avoid accidental work surface movement or an injury that could be associated with an unintended flipping motion of the work surface. The upward force that may be applied by the gas spring 61 may not be sufficient to fully raise the work surface, but may be sufficient to maintain the work surface in its flipped position. Such a configuration for the gas spring 61 can also help ensure that after an actuator 13 is manipulated by a user to move the first locking structure 47 into a fully unlocked position, that the work surface 3 is not unintentionally moved too quickly to its flipped position, which can also help avoid injury or an accidental work surface movement.

A privacy screen apparatus 8 can be connected to the work surface 3 or positioned adjacent the work surface 3 via attachment to another element of the article of furniture 1. The privacy screen apparatus 8 can include an upper privacy screen 8*a* and a lower privacy screen 8*b* that can be configured as a "modesty" screen by providing a visible barrier for the legs, knees and/or midsections of a person who may be seated at the work surface.

The upper privacy screen apparatus 8 can include an upper screen body 71 that is retained by upper screen body attachment mechanisms 73. Each upper screen body attachment mechanism 73 can be attached adjacent to a respective side of the screen body 71 (e.g. a first upper screen body attachment mechanism 73 can be located within 12-18 inches of the first peripheral edge of the work surface adjacent the front edge 3*f* and a second upper screen body attachment mechanism 73 can be located 12-18 inches of the second peripheral edge of the work surface adjacent the front edge 3*f* of the work surface 3, etc.). Each upper screen body attachment mechanism 73 can include a pair of opposed holding members 74 such as a front holding member 74*b* that is spaced apart from a rear holding member 74*a* to define a gap in which the upper screen body 71 is retained. The gap between the holding members 74 and the holding members can be configured to provide an interference fit for retaining the upper screen body 71. Also (or as an alternative to only relying upon an interference fit), one or more fasteners can be passed through the front and rear holding members 74*b* and 74*a* as well as the upper screen body 71 after the upper screen body 71 is inserted into this gap to attach the upper screen body 71 to the holding members 74. The holding members 74 can extend vertically from a clamping member 76. The clamping member can include an upper jaw 76*a* and a lower jaw 76*b* that are interconnected to each other via an intermediate jaw member 78. The lower jaw 76*b* can be spaced apart from the upper jaw 76*a* so that the full structure of the work surface (e.g. an entirety of the width or thickness of a section of a tabletop or desktop) can be received within the gap between the upper jaw 76*a* and lower jaw 76*b*. The intermediate jaw member 78 can be configured to extend over the front edge 3*f* of the work surface between the upper jaw 76*a* and lower jaw 76*b*. The lower jaw 76*b* can be connected to a moveable clamping member 77 that is moveable into the gap between the upper and lower jaws 76*a* and 76*b* to engage the bottom of the work surface structure for ensuring a tight fit of the work surface within the upper and lower jaws. The clamping member 77 can be a set screw or bolt that is rotatable via a knob handle attached to the head of the screw or bolt for rotating in opposite directions for tightening and loosening the clamping member 77 relative to the work surface 3 (e.g. rotation in a first direction can drive the clamping member 77 toward the upper jaw 76*a* and rotation in an opposite second direction can drive the clamping member 77 to move away from the upper jaw 76*a*).

The lower jaw and/or the intermediate jaw member 78 can also define an opening 78*a* that is sized and configured to receive and/or retain a portion of a lower privacy screen connector 91 for connecting the lower privacy screen 8*b* to the upper privacy screen 8*a* and also attaching the lower privacy screen 8*b* to the work surface 3 to position the lower privacy screen below the front edge 3*f* of the work surface. An upper end portion of the lower privacy screen connector 91 can be received in the opening 78*a* for connection of the lower privacy screen connector 91 to the upper screen body attachment mechanism 73. The upper end 91*a* of the lower privacy screen connector 91 can have a profile configured to mate with a profile defined in the opening 78*a* for providing an interlock attachment for the lower privacy screen connector 91 and the lower jaw 76*b* or intermediate jaw member 78. One or more fasteners could also be utilized to help affix or otherwise attach the upper end of the lower privacy screen connector 91 to the lower jaw 76*b* or intermediate jaw member 78.

As may be best appreciated from FIGS. 11-13, 17 and 18, the lower end 91*b* of the lower privacy screen connector 91 can be connected to a lower privacy screen body 80. For instance, vertical elongated lower privacy screen body clamping members 83 can be fastened to the lower privacy screen body 80 via fasteners 92 passed through the lower privacy screen body clamping members 83 and the lower privacy screen body 80 that are configured to connect the lower end of the lower privacy screen connector 91 to the lower privacy screen body 80. In some embodiments, there may be a rear lower privacy screen body clamping member 83*a* positioned on a rear face of the lower privacy screen body 80 that is aligned with a front lower privacy screen body clamping member 83*b* positioned along the front face of the lower privacy screen body. Upper ends of the front and rear pair of lower privacy screen clamping members 83*a* and 83*b* can be configured to contact and engage the lower end of the lower privacy scree connector 91 to hold the lower end of the lower privacy screen connector 91 and attach that connector to the lower privacy screen body 80.

During assembly, the front and rear clamping members and the lower end of the lower privacy screen connector can all be positioned on the lower privacy screen body. Then, fasteners 92 can be passed through the clamping members and the lower privacy screen body 80 for fastening the clamping members 83 to the lower privacy screen body 80. The fastening can be performed so that the clamping members 83 are brought into contact with the lower end of the lower privacy screen connector 91 to grip and hold that lower end of the connector on the top edge of the lower privacy screen body 80 for attachment of the connector to the lower privacy screen body 80. The upper edge of the privacy screen body 80 can also be configured to facilitate positioning and holding of the lower end of the lower privacy screen connector 91.

It should be appreciated that the lower privacy screen clamping members 83 can be arranged in pairs where a pair of front and rear lower privacy screen clamping members 83*b* and 83*a* are arranged on opposed faces of the privacy screen body 80 for attachment of the clamping members to the screen body 80 via fasteners. Each pair can be positioned at a particular section of the lower privacy screen body for facilitating a desired attachment to the work surface 3 and/or upper privacy screen body 8*a* (e.g. there may be a pair adjacent each respective end or side of the lower privacy screen body 80, there may be a pair of clamping members 83 adjacent each respect end or side as well as at least one intermediate pair positioned between those two clamping member pairs, etc.).

In some embodiments of the privacy screen apparatus 8, there may only be an upper privacy screen 8*a*. In yet other embodiment, there may only be a lower privacy screen 8*b*. For embodiments that do not utilize a lower privacy screen 8*b*, there may not be a lower privacy screen connector 91. For embodiments that may not include an upper privacy screen 8*a* but do include a lower privacy screen 8*b*, the upper end of the lower privacy screen connector 91 can be attached to an underside of the work surface 3 adjacent the front edge 3*f* of the work surface or another portion of the article of furniture 1 to position the lower privacy screen body 80 at and/or below the front edge 3*f* of the work surface 3. For instance, as can be appreciated from FIGS. 15 and 16, the upper end 91*a* of a lower privacy screen connector 91 can be fastened to the bottom of a work surface 3 via a fastener 95 being passed through the upper end 91*a* (e.g., through a hole in the upper end 91*a* so that a head of the fastener 95 contacts the upper end 91*a* to fasten the upper end 91*a* to the work surface 3). The upper end 91*a* of the lower privacy screen connector 91 can be positioned in an attachment receptacle 93 that is positionable between the bottom of the work surface 3 and the upper end 91*a* of the lower privacy screen connector 91. The receptacle 93 can include an aperture sized to receive the upper end 91*a* to help facilitate attachment of the lower privacy screen connector 91 to the work surface 3.

Each lower privacy screen connector 91 can be fastened at a respective spaced apart location along the bottom of the work surface for attaching the lower screen body 80 to the work surface adjacent the front edge of the work surface and below the front edge 3*f* of the work surface 3. Each lower privacy screen connector can be so positioned so that its lower end 91*b* is attached to a respective pair of front and rear lower privacy screen body clamping members 83*b* and 83*a* for positioning of the lower privacy screen body 80 below the work surface 3.

The lower privacy screen connector 91 can be a body composed of an elastomeric material (e.g. Hytrel® elastomeric material, which is a type of thermoplastic polyester elastomer made by E. I. du Pont de Nemours and Company, or other type of elastomeric material such as rubber, a synthetic rubber or an elastomeric polymeric material, etc.) or include such a body. The body of the lower privacy screen connector 91 could alternatively be composed of a resilient, flexible material that is not particularly elastomeric (e.g. a type of non-elastomeric polymeric material, or a metal body having a resilient, flexible configuration, a leaf spring, etc.).

The flexibility of resiliency of the lower privacy screen connectors 91 used for mounting of the lower privacy screen body 80 can permit the lower privacy screen body to swing or otherwise move when the work surface is moved from its work position to its flipped position. Such flexible hanging of the lower privacy screen body 80 can help facilitate furniture nesting by being flexibly moveable while the work surface is in the flipped position. This flexible attachment can permit the lower privacy screen 8*b* to be moved in response to another flipped work surface contacting the lower privacy screen body 80 for compact nesting, for example. The flexible attachment can also help permit the force of gravity to orient the lower privacy screen so that it extends downwardly when the work surface is in the flipped position while also facilitating the downward extension of the lower privacy screen 8*b* when the work surface is in the work position. This can allow the lower privacy screen 8*b* to remain attached to the work surface 3 even during flipping of the work surface or nesting of the work surface, which can allow for an easier, more efficient use of the article of furniture for both storage (e.g. nesting) and use applications (e.g. laying out the articles of furniture in a meeting or work plan layout) without having to remove and reattach the lower privacy screen 8*b* (to the extent the privacy screen apparatus 8 also includes the upper privacy screen 8*a*, this upper privacy screen 8*a* may need to be removed for nesting of the articles of furniture, but the lower privacy screen 8*b* would not need to be removed).

Further, this can also allow mobile articles of furniture to more efficiently and easily provide modesty screen protection for personnel seated for work at the work surface. This can help improve the comfort and well-being of some seated personnel (e.g. personnel who may wear a dress or other similar type of clothing) by blocking vision of third parties to the seated mid-section area of the seated personnel while also reducing the time and costs associated with deploying one or more articles of furniture 1 from a stowed, nested position to a work position. For instance, the comfort of a user can be improved as a seated person may not feel the need to have to sit with crossed legs while seated at a particular work surface 3 due to the presence of the lower privacy screen 8*b* that can be present on a stowed, nested article that is subsequently quickly deployed to a work position in an office environment for a meeting or conference.

It should be appreciated that embodiments of the flipping actuation mechanism, privacy screen apparatus, and furniture having one or more of such mechanisms can be configured differently. For example, the shape and size of the tabletop, work surface or other structure of the furniture can be any of a number of different shapes and sizes. In some embodiments, the tabletop can be defined by one unitary structure (e.g. a tabletop formed of one unitary piece of stone, wood, composite material, polymeric material, or metal) or by interconnected structures fastened or otherwise joined together (e.g. a tabletop that is comprised of two or more interconnected pieces where each piece is connected to at least one other piece by a fastening mechanism such as adhesive, welding, fasteners, or other type of fastening apparatus). In yet other embodiments, the tabletop may be another type of work surface, such as the seat of a bench that is configured to be sat on when it is in the first position. As yet another example, each element of the article of furniture, flipping actuation mechanism and privacy screen apparatus can be composed of any type of material that can help meet a particular design objective such as a metal, an elastomeric material, a polymeric material, or be composed of a combination of such materials due to the interconnection of different structures formed of different types of materials to form that element. As yet another example, the second locking structure 57 can be connected to the lower element 17*b* or the upper element 17*a*. For embodiments in which the actuation member 43 is moveably attached to the upper element 17*a*, the second locking structure 57 can be attached to or extend from the lower element 17*b*. For embodiments in which the actuation member 43 is moveably attached to the lower element 17*b*, the second locking structure 57 can be attached to or extend from the upper element 17*a*. In embodiments in which the second locking structure 57 is attached to the upper element 17*b*, the second locking ramp 57*d* and first locking ramp 47*d* can have different angles at which they extend so that the projecting portion 57*c* of the second locking structure is an upper portion of the second locking structure that extends outwardly to the top of the second locking ramp 57*d* for defining a space for retaining a portion of the first locking structure 47 therein when the actuation member 43 is in its initial position to help lock that actuation member in its initial position and lock the work surface 3 in its work position. The shape and degree of inclination or declination of the first and second locking ramps may different to meet such a design objective. Also, the bottom of the first locking structure 47 may be smooth and flat for sliding along the projecting portion 57*c* instead of (or in addition to) a top upper surface 47*c* having such a configuration.

As yet another example, it is contemplated that a particular feature described, either individually or as part of an embodiment, can be combined with other individually described features, or parts of other embodiments. The elements and acts of the various embodiments described herein can therefore be combined to provide further embodiments. Therefore, it should be understood that while certain exemplary embodiments of articles of furniture (e.g. desks or tables), flipping mechanisms for articles of furniture, flipping actuation mechanisms for articles of furniture, privacy screen apparatuses for articles of furniture, and methods of making and using the same have been discussed and illustrated herein, it is to be distinctly understood that the invention is not limited thereto but may be otherwise variously embodied and practiced within the scope of the following claims.

What is claimed is:

1. An article of furniture comprising:

a base that supports a work surface;

a first flip connector attaching the work surface to the base such that the work surface is moveable between a first position and a second position;

the first flip connector comprising:

a housing having a first upper element attachable to the work surface and a second lower element attachable to the base, the first upper element being moveable relative to the second lower element;

an actuation member;

a guide passing through the actuation member;

an elongated member passing through the actuation member; and a biasing member positioned adjacent the guide that engages the actuation member to bias the actuation member to an initial position; and wherein the first flip connector also comprises:

a first locking structure attached to the actuation member, the first locking structure defining a first locking ramp having an upper end and a lower end, the first locking ramp extending linearly from the upper end to the lower end along a first pre-selected angle.

2. The article of furniture of claim 1, wherein the first locking structure also comprises an upper surface that extends from the upper end of the first locking ramp and is adjacent a wall of the actuation member that extends vertically above the upper surface of the first locking structure.

3. The article of furniture of claim 2, wherein the first flip connector comprises:

a second locking structure having a second locking ramp that is configured to cooperate with the first locking ramp such that the first locking ramp is contactable with the second locking ramp and slideable along the second locking ramp such that sliding of the first locking ramp along the second locking ramp drives motion of the actuation mechanism attached to the first locking structure so that the actuation mechanism moves between the initial position and an unlocking position as the first locking ramp slides along the second locking ramp.

4. The article of furniture of claim 3, wherein the first locking ramp slides from a top of the second locking ramp to a bottom of the second locking ramp to drive motion of the actuation mechanism from the initial position to the unlocking position.

5. The article of furniture of claim 4, wherein the second locking structure has a projecting portion that extends from a body of the second locking structure to the bottom of the second locking ramp, the upper surface of the first locking structure being slideable along the projecting portion as the actuation member is moved from the unlocking position to the initial position after the first locking structure has moved below the bottom of the second locking ramp.

6. The article of furniture of claim 5, comprising:

a second flip connector attaching the work surface to the base such that the work surface is moveable between the first position and the second position;

the second flip connector comprising:

a housing having a first upper element attachable to the work surface and a second lower element attachable to the base, the first upper element being moveable relative to the second lower element;

an actuation member;

a guide passing through the actuation member such that the actuation member is moveable along the guide between an initial position and an unlocking position;

the elongated member passing through the actuation member;

a biasing member positioned adjacent the guide that engages the actuation member to bias the actuation member to the initial position;

a first locking structure attached to the actuation member, the first locking structure defining a first locking ramp having an upper end and a lower end, the first locking ramp extending linearly from the upper end to the lower end at a first pre-selected angle;

the first locking structure also comprising an upper surface that extends from the upper end of the first locking ramp and is adjacent a wall of the actuation member that extends vertically above the upper surface of the first locking structure;

a second locking structure having a second locking ramp that is configured to cooperate with the first locking ramp such that the first locking ramp is contactable with the second locking ramp and slideable along the second locking ramp such that sliding of the first locking ramp along the second locking ramp drives motion of the actuation mechanism attached to the first locking structure so that the actuation mechanism moves between the initial position and the unlocking position as the first locking ramp slides along the second locking ramp;

the first locking ramp slides from a top of the second locking ramp to a bottom of the second locking ramp to drive motion of the actuation mechanism from the initial position to the unlocking position; and the second locking structure has a projecting portion that extends from a body of the second locking structure to the bottom of the second locking ramp, the upper surface of the first locking structure being slideable along the projecting portion as the actuation member is moved from the unlocking position to the initial position after the first locking structure has moved below the bottom of the second locking ramp.

7. The article of furniture of claim 6, comprising:

a privacy screen apparatus comprising a lower privacy screen body that is positioned below a front edge of the work surface, the lower privacy screen body being attached to the work surface via a plurality of resilient lower privacy screen connectors.

8. The article of furniture of claim 7, wherein the privacy screen apparatus comprises an upper privacy screen body that is attached to the lower privacy screen body via the resilient lower privacy screen connectors, the upper privacy screen body attached to the work surface so that the upper privacy screen body extends above the work surface.

9. An article of furniture comprising:

a base that supports a work surface;

a first flip connector attaching the work surface to the base such that the work surface is moveable between a first position and a second position;

the first flip connector comprising:

a housing having a first upper element attachable to the work surface and a second lower element attachable to the base, the first upper element being moveable relative to the second lower element;

an actuation member;

a guide passing through the actuation member;

an elongated member passing through the actuation member; and a biasing member positioned adjacent the guide that engages the actuation member to bias the actuation member to an initial position; and wherein the guide has a first end and a second end opposite the first end of the guide, the first end defining a lower ramped surface, the guide being connected to the actuation member so that motion of the actuation member also results in motion of the guide, the first end of the guide spaced apart from the actuation member when the actuation member is in the initial position, the second end of the guide also being spaced apart from the actuation member.

10. The article of furniture of claim 9, wherein the lower element of the housing has a component, the component of the lower element of the housing having an opening through which the first end of the guide is passable.

11. The article of furniture of claim 10, wherein the lower ramped surface is configured to contact a top of the component of the lower element to move the guide away from the component so that the actuation member is moved from the initial position toward an unlocking position.

12. The article of furniture of claim 11, comprising:

a second flip connector comprising:

a housing having a first upper element attachable to the work surface and a second lower element attachable to the base, the first upper element being moveable relative to the second lower element;

an actuation member, the elongated member passing through the actuation member;

a guide passing through the actuation member; and a biasing member positioned adjacent the guide that engages the actuation member to bias the actuation member to the initial position.

13. The article of furniture of claim 10, wherein the lower element of the housing of the second flip connector has a component, the component of the lower element of the housing of the second flip connector having an opening through which a first end of the guide of the second flip connector is passable.

14. The article of furniture of claim 13, wherein a lower ramped surface of the first end of the guide of the second flip connector is configured to contact a top of the component of the lower element of the second flip connector to move the guide of the second flip connector away from the component so that the actuation member of the second flip connector is moved from the initial position toward an unlocking position when the work surface is moved from the second position to the first position.

* * * * *